US010136744B2

(12) United States Patent
Mintz

(10) Patent No.: US 10,136,744 B2
(45) Date of Patent: Nov. 27, 2018

(54) ELECTRICALLY HEATED FOOT CANOPY FOR BED TOP SHEETS, BLANKETS, QUILTS, BEDS OR SLEEPING BAGS AND THE LIKE

(71) Applicant: Harold P. Mintz, Fort Lee, NJ (US)

(72) Inventor: Harold P. Mintz, Fort Lee, NJ (US)

(73) Assignee: Harold P. Mintz, Fort Lee, NJ (US)

( * ) Notice: Subject to any disclaimer, the term of this patent is extended or adjusted under 35 U.S.C. 154(b) by 434 days.

(21) Appl. No.: 15/040,238

(22) Filed: Feb. 10, 2016

(65) Prior Publication Data

US 2016/0278552 A1 Sep. 29, 2016

Related U.S. Application Data

(63) Continuation-in-part of application No. 14/665,785, filed on Mar. 23, 2015, now Pat. No. 9,332,853.

(51) Int. Cl.

| | |
|---|---|
| ***A47G 9/08*** | (2006.01) |
| ***A47G 21/04*** | (2006.01) |
| ***H05B 3/34*** | (2006.01) |
| ***H05B 3/36*** | (2006.01) |
| ***H05B 3/14*** | (2006.01) |
| *A47C 21/04* | (2006.01) |

(52) U.S. Cl.

CPC ..... *A47G 9/086* (2013.01); *H05B 3/145* (2013.01); *H05B 3/36* (2013.01); *A47C 21/04* (2013.01); *H05B 2203/003* (2013.01)

(58) Field of Classification Search

CPC ..... A47G 9/08; A47G 9/083; A47G 9/086; A47C 21/048; A47C 21/04; H05B 3/34; H05B 3/342; H05B 3/347; H05B 3/54; H05B 2203/002; H05B 2203/003; H05B 2203/015; A41B 13/06; A41B 13/065

USPC ..... 5/413 R, 413 AM, 421, 284; 219/212, 219/217, 527, 529, 545, 549; 2/69, 69.5

See application file for complete search history.

(56) References Cited

U.S. PATENT DOCUMENTS

| | | | | |
|---|---|---|---|---|
| 2,577,178 | A * | 12/1951 | Bellinger | A47G 9/0246 5/485 |
| 3,254,348 | A * | 6/1966 | Di Addario | A47G 9/0246 5/497 |
| 3,380,087 | A * | 4/1968 | Petty et al. | H05B 3/342 219/212 |
| 3,427,431 | A * | 2/1969 | Costanzo | H05B 3/342 219/211 |
| 3,443,066 | A * | 5/1969 | Weibel | H05B 3/342 2/69.5 |
| 4,021,869 | A * | 5/1977 | Root | A47G 9/0246 5/485 |
| 4,304,018 | A * | 12/1981 | McClam | A47G 9/0238 5/485 |

(Continued)

*Primary Examiner* — Robert G Santos

(74) *Attorney, Agent, or Firm* — Carlos R. Villamar; The Villamar Firm PLLC

(57) ABSTRACT

A sleeping bag includes a top portion; and a bottom portion, with the bottom portion including a back-folded foot canopy therein configured to allow expansion when feet of a user are extended in an upward direction therewithin and providing room and maneuverability for the feet of the user. The sides of the foot canopy comprise walls formed by back folds each extending substantially across a width of the bottom portion and said walls and back folds are opposite and spaced apart from each other.

9 Claims, 21 Drawing Sheets

(56) References Cited

U.S. PATENT DOCUMENTS 5,528,779 A * 6/1996 Lee ..... A47C 7/66 2/69.5
6,073,282 A * 6/2000 Leeper ..... A47G 9/086 2/69.5
6,175,976 B1 * 1/2001 Cantwell ..... A47G 9/086 2/69.5
6,313,438 B1 * 11/2001 Emerick, Jr. ..... A47G 9/086 2/69
6,438,774 B1 * 8/2002 Michaelis ..... A47G 9/086 2/69.5
8,051,509 B2 * 11/2011 SiKui ..... A47G 9/086 5/413 R
8,127,378 B1 * 3/2012 Mintz ..... A47G 9/0246 5/485
8,214,949 B2 * 7/2012 Thompson ..... A47G 9/02 5/485
8,490,229 B2 * 7/2013 Mintz ..... A47G 9/0246 5/485
8,984,683 B2 * 3/2015 Mintz ..... A47C 21/048 219/212
9,332,853 B2 * 5/2016 Mintz ..... A47C 21/048
2004/0255381 A1 * 12/2004 Generalovich, II . A47G 9/0238 5/495
2010/0024126 A1 * 2/2010 SiKui ..... A47G 9/0215 5/413 R
2010/0043144 A1 * 2/2010 Thompson ..... A47G 9/02 5/485
2012/0159710 A1 * 6/2012 Mintz ..... A47G 9/0207 5/505.1
2013/0291302 A1 * 11/2013 Mintz ..... A47C 21/048 5/421
2015/0047124 A1 * 2/2015 Tate ..... A47G 9/0246 5/495
2015/0189995 A1 * 7/2015 Mintz ..... A47C 21/048 5/421
2016/0278552 A1 * 9/2016 Mintz ..... H05B 3/145

* cited by examiner

300

400

500

600

600

800

900

1000

702
716
714
704
710

702
716
714
704
710

702
716
714
716
704
710

ELECTRICALLY HEATED FOOT CANOPY FOR BED TOP SHEETS, BLANKETS, QUILTS, BEDS OR SLEEPING BAGS AND THE LIKE

CROSS REFERENCE TO RELATED DOCUMENTS

The present invention is a continuation in part of U.S. patent application Ser. No. 14/665,785 of Harold P. MINTZ, entitled "ELECTRICALLY HEATED FOOT CANOPY FOR BED TOP SHEETS, BLANKETS, QUILTS OR BEDS AND THE LIKE," filed on Mar. 23, 2015, now U.S. Pat. No. 9,332,853, which is a continuation of U.S. patent application Ser. No. 13/938,743 of Harold P. MINTZ, entitled "ELECTRICALLY HEATED FOOT CANOPY FOR BED TOP SHEETS, BLANKETS, QUILTS OR BEDS AND THE LIKE," filed on Jul. 10, 2013, now U.S. Pat. No. 8,984,683, which is a continuation in part of U.S. patent application Ser. No. 13/411,807 of Harold P. MINTZ, entitled "GUSSETED FOOT CANOPY FOR BED TOP SHEETS, BLANKETS, QUILTS OR BEDS AND THE LIKE," filed on Mar. 5, 2012, now U.S. Pat. No. 8,490,229; which is a continuation U.S. patent application Ser. No. 12/914,283 of Harold P. MINTZ, entitled "GUSSETED FOOT CANOPY FOR BED TOP SHEETS, BLANKETS, QUILTS OR BEDS AND THE LIKE," filed on Oct. 28, 2010, now U.S. Pat. No. 8,127,378, the entire disclosures of all of which are hereby incorporated by reference herein.

BACKGROUND OF THE INVENTION

Field of the Invention

The present invention generally relates to bed top sheets, blankets, and quilts, and the like ("bed top coverings") as well as to sleeping bags, and more particularly to bed top coverings, beds, or sleeping bags that have an ergonomic foot canopy at the bottom thereof and that can be configured to be electrically heated as well.

Discussion of the Background

Over the years, mass production has led to the standardization of international mattress sizes from crib/toddler to twin to double to queen to king and California king, and the like. Similarly, background art sheeting, blankets, and quilts and sleeping bags also have been standardized in terms of lengths and widths. However, such background art bed top coverings and sleeping bags are not designed to allow for comfort or for providing electrical warmth for a user when the user is in a reclined position on his or her back with the feet pointing upward. This is particularly true when the bed top coverings are tucked in under the mattress; and, by definition, always the case with sleeping bags which are closed at the feet.

SUMMARY OF THE INVENTION

Therefore, there is a need for bed top sheets, blankets, and quilts, and the like ("bed top coverings") or beds or sleeping bags that overcome the deficiencies in the background art bed top coverings and are configured to allow for comfort for a user when the user is in a reclined position underneath the sleeping bags or bed top coverings with feet pointing upward and with respect to the bed top coverings tucked in under the mattress. In addition, there is a need for bed top coverings or sleeping bags that overcome the deficiencies in the background art bed top coverings or sleeping bags and are configured with the back-folded, electrically heated, foot canopy to allow for warmth and ergonomic comfort for a user particularly when the user is in a reclined position with his or her feet pointing upward underneath the bed top coverings particularly when they are tucked in under the mattress or in sleeping bags.

The above and other needs are addressed by exemplary embodiments of the present invention, which include improved bed top coverings or beds or sleeping bags that incorporate a gusseted foot canopy at a bottom thereof. Advantageously, such bed top coverings or beds or sleeping bags add ergonomics, pragmatics, and comfort to allow persons to recline on their backs with their toes pointed toward the ceiling in far greater comfort than what is possible with background art bed coverings or beds or sleeping bags. In addition, the exemplary gusseted foot canopy helps eliminate foot cramping, as the vast majority of people are unable to point their toes under the covers or sleeping bag for an extended period of time, let alone point them upward at all, with background art bed coverings or sleeping bags, especially when the background art bed coverings especially when the background art bed coverings are in a "tucked in" position or state or sleeping bags which generally are always tight on the feet. In addition, the exemplary embodiments of the present invention can further include improved bed top coverings or sleeping bags that incorporate a back-folded, electrically heated, foot canopy at the bottom thereof. The back-folded foot canopy utilizes a modified hairpin or pleated/accordion design so that it lays flat when not in use and expands when a user's feet enters the canopy. Advantageously, such bed top coverings or sleeping bags add ergonomics, pragmatics, comfort, and less potential exposure to Electric and Magnetic Field ("EMF") radiation and allow persons to recline in bed on their backs or in the sleeping bag with their toes naturally pointed toward the ceiling in far warmer comfort than what is possible with background art electric blankets, especially when the background art electric blankets are in a tucked in position or state around and underneath the mattress and the sleeping bags are fully zipped up.

Accordingly, in an exemplary aspect there is provided a sleeping bag including a top portion; and a bottom portion, with the bottom portion including a back-folded foot canopy therein configured to allow expansion when feet of a user are extended in an upward direction therewithin and providing room and maneuverability for the feet of the user. The sides of the foot canopy comprise walls formed by back folds each extending substantially across a width of the bottom portion and said walls and back folds are opposite and spaced apart from each other.

The bottom portion includes the foot canopy being electrically heated and providing warmth from a heating element incorporated into at least one of a ceiling of the foot canopy, and sides of the foot canopy.

A top or ceiling of the back-folded foot canopy is one of a rectangular shape, a dome shape, a round shape, and a pointed shape.

Sidewalls of the back-folded foot canopy allow for expansion due to a hairpin fold that functions as a large pleat when in use, and/or flexible material, and including a pleated or accordion-type structure that also allows the canopy to further drape the feet when in use.

The foot canopy is configured as a vaulted foot-tent at the bottom portion of the sleeping bag.

The back-folded foot canopy is made from the same or similar material to the top portion of the sleeping bag.

The back-folded foot canopy is made from a different material than the top portion of the sleeping bag.

The heating element comprises insulated wires including carbon fiber wires that heat up when a control is on and when plugged into a wall electrical socket or connected to a battery.

The bottom portion includes the foot canopy which is electrically heated and provides warmth from a single heating element or multiple heating elements incorporated into at least one of the ceiling or sides of the foot canopy.

Still other aspects, features, and advantages of the present invention are readily apparent from the following detailed description, simply by illustrating a number of exemplary embodiments and implementations, including the best mode contemplated for carrying out the present invention. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which:

FIG. 12 is illustrative only, in practice, the canopy 106' will take on a more pointed shape when it is in use, as it will drape over the user's feet and not maintain its not in use folded flat composition when in use;

DETAILED DESCRIPTION OF THE PREFERRED EMBODIMENTS

Figure 1:
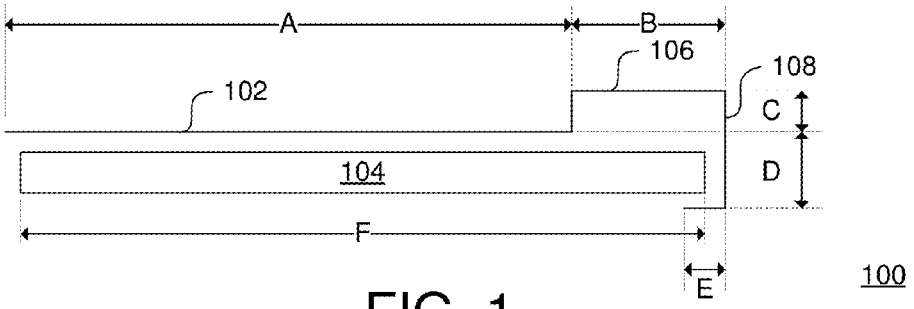
FIG. 1 illustrates a cut away, side view of an exemplary bed top covering with a foot canopy at a bottom thereof.

Generally, the present invention includes recognition that while beds and mattresses have evolved enormously, sheets and other bedding has not. The current state of bed sheet technology customarily includes a bottom sheet that is fitted with elastic to keep it from slipping off the mattress and a matching top sheet, basically a simple rectangular sheet of cloth, that is tucked in at the foot of the bed under the mattress to maintain neatness and enable the sleeper to be "tucked in" between the two comfortable (top and bottom) bed sheets. The bottom sheet is usually differentiated only by length and width; however, the top sheet generally has a distinct header and footer with the header of the sheet characterized by a wider, more decorative and/or monogrammed seam that is kept at the head of the bed with the sheet pattern facing downward so that when it is folded back to the foot of the bed (usually over a blanket or comforter), the design is exposed.

As our life styles have altered dramatically over the last half century, so too has the role of the bed. The bed has become far more than the province of sleeping and conjugality. With most bedrooms sporting flat-panel TVs and their occupants possessing laptops, iphones, ipads, droids, blackberries, kindles, etc., today's bed has become the locus of more and more informal and leisurely entertainment, reading, communication, and commerce. Many prefer to engage in these activities in bed just prior to calling it a night, first thing in the morning before they are willing to truly declare a start to the day, while not feeling well or incapacitated, or simply for comfort when there is inclement weather and/or a chill in the air. Thus, the person often prefers to have his or her lower body under the covers as the covers make the bed snuggly and offers protection from colder ambient air temperatures. The present invention contemplates these activities being done by a user reclined on his or her back with his or her head and upper torso propped up by pillows and his or her feet pointing naturally upward.

The present invention includes recognition of the problem that such a reclined position under the covers is not as comfortable as it ought to be, as it forces the individual's feet to point skyward and the room at the foot of the bed is insufficient to accommodate the foot's full extension. Moreover, as the top sheet and blankets are often tucked in 8-12" around the mattress and then another couple of inches underneath the end of the bed to keep things neat, tidy, and together, the taller the person is and/or the more tucked in he or she is the more the person's feet are subject to a nutcracker effect because they are situated in a veritable bed sheet fulcrum. It is actually for this reason that many people who prefer to sleep on their backs do so in a manner so that their feet are uncovered and free from the mechanical force (effort) of the cloth lever.

Therefore, the present invention includes recognition that there is a need for modernization of traditional bed top coverings so that a person may be tucked in under the covers in a reclined position on his or her back in far greater comfort than traditional bedding allows for.

The present invention includes recognition that previous electrically heated sheeting, blankets, and quilts are designed for warmth but not designed to allow for particular comfort when the user is in a reclined position underneath the bed top coverings with his or her feet pointing upward and with the bed top coverings tucked in under the mattress. The back-folded, electrically heated, foot canopy eliminates the mechanical force of the taut tucked in sheet ("the nutcracker effect") on a user's feet.

In addition, electrically heated sheeting, blankets, and quilts are designed for warmth of the entire body when, for many people, the body part requiring the most warmth is the feet, including those users who do not like to wear socks when they sleep. In addition, with electrically heated sheeting, blankets, and quilts designed for warmth of the entire body, the potentially harmful electric and magnetic field ("EMF") of such electric bed top coverings literally blankets the user with an EMF. This invention focuses the EMF only on the feet which is likely far more salutary for the body from an EMF perspective. Moreover, in an exemplary embodiment, the back-folded foot canopy is heated via rechargeable batteries instead of being plugged into the wall socket—all but eliminating the EMF concerns. Moreover, typical electric blankets require enough electricity to heat the entire bed top covering. By contrast, the present invention saves energy as, in an exemplary embodiment, only the back-folded, electrically heated foot canopy is heated and the balance of the bed top covering is not.

Accordingly, many persons who suffer from cold feet when they sleep have little or no interest in having a heated electric blanket covering their entire body. A popular theory among cold weather scientists is that warm feet makes for warm blood, as the warmer extremities are sensed by the brain which assumes that if the extremities are warm, the internal organs must also be warm so the brain then tells the heart it is okay to keep pumping blood to the extremities. Following the same logic, keeping the feet comfortable can reduce cold stress and support stability and thermoregulation during sleep as the brain senses that all is thermally copacetic.

Many people suffer cold feet due to a host of medical problems including hypertension, diabetes, distressed thyroid levels, edema, anemia, Raynaud's Syndrome (where stress, tension, and emotional disturbances narrow the small blood vessels in extremities and cause the feet to turn to icy), high cholesterol, and vitamin deficiencies. Cold feet may also be in response to drugs taken. For example, beta blockers can decrease the heart rate and reduce the circulation of blood to the hands and feet; and calcium channel blockers, which are used to treat hypertension, can relax the blood vessels and cause body heat loss. Simple aging can reduce a person's once buoyant blood supply resulting in distal hypothermia—cold extremities. And, of course, there are just plain old cold feet. Studies have found that women are nine times more likely to develop cold in their extremities than men. The present invention directly addresses the need for warmer more comfortable feet particularly when a user is in bed on his or her back under the covers with the feet naturally pointing upwards. Prior, the user's cold feet were likely in socks and straining against the mechanical force of the taut, tucked in sheet; or, in some cases, the user's cold feet were in socks sticking out from where the covers were untucked.

Another dilemma with background art is the EMF generated by household appliances, including background art electric blankets, has been linked to an increased risk of cancers such as leukemia, breast cancer, endometrial cancer, lymphoma, and other health conditions including miscarriages, birth defects, Alzheimer's disease, Lou Gehrig's disease, depression, and suicide. Further EMFs can suppress the secretion of melatonin from the pineal gland at night. Melatonin is the most important detox agent for a person's brain, an anti-inflammatory, and the main hormone that initiates our sleep cycle. Anecdotally, EMFs have been associated with symptoms such as nausea, headache, fatigue, anxiety, dizziness, mental confusion, memory loss, sleep disturbance, itchy or burning skin sensations, and skin rashes. There are increasing numbers of people who report hypersensitivity to EMFs similar to the way that some individuals have become hypersensitive to chemicals as the result of over-exposure.

The exact mechanism by which EMF exposure leads to cancer, affects gene and protein expression (the fields of Transcriptomic and Proteomic Research), induces stress response, and affects immune function and neurology has not been established. One potential explanation may be that EMF's ability to alter certain genes by turning them on and off at inappropriate times may cause them to initiate cell proliferation. Accordingly, another advantage of an exemplary embodiment of the present invention is that focusing the electrical warmth on the feet (as in an exemplary embodiment only the back-folded foot canopy is heated) versus on the entire body as is done by background art (which many contend have EMFs that continuously penetrate 6-7 inches into the body) would likely be easier on a user's internal organs and therefore a preferable configuration for users from a health and chronic exposure perspective.

Thus, the exemplary back-folded, electrically heated, foot canopy provides heat to the feet and helps alleviate foot discomfort and even cramping, as many people become uncomfortable pointing their toes or turning them outward under the covers for an extended period of time to escape the nutcracker effect of the taut tucked in bed top coverings on their fulcrum feet.

Accordingly, the present invention includes recognition that while background electric blankets' technology has evolved their ergonomics have not. None take into account the need for a person reclined on his or her back to have a back-folded electrically heated foot canopy so that he or she may comfortably and warmly extend his or her feet with the toes pointing naturally upwards obviating the need to point the toes or turn the feet outwards to avoid the mechanical force of the taut tucked in bed top covering which causes discomfort and sometimes engenders cramps.

Moreover, with the current state of electric blankets, many cannot be tucked in and around ultra wide and ultra heavy mattresses because of the fear of damaging the heating elements, causing a short or other electrical hazard, as well as to avoid subjecting the wires or heating elements to excessive wear or great pressure under the heavy mattress. An exemplary embodiment of the present invention takes this into account by having the top covering divided compartmentally into three distinct sections: the top part is the largest portion of the bed top covering that covers most all of a user's body; and in an exemplary configuration, this portion is not electrically heated. The second portion is the back-folded electrically heated foot canopy that is designed to ergonomically allow the feet to naturally point upwards when the user is reclined on his or her back while also warming the feet. The third portion is below the foot canopy; and, in an exemplary configuration, this portion is not heated and is there to be tucked in, around, and underneath the mattress.

Figure 2:
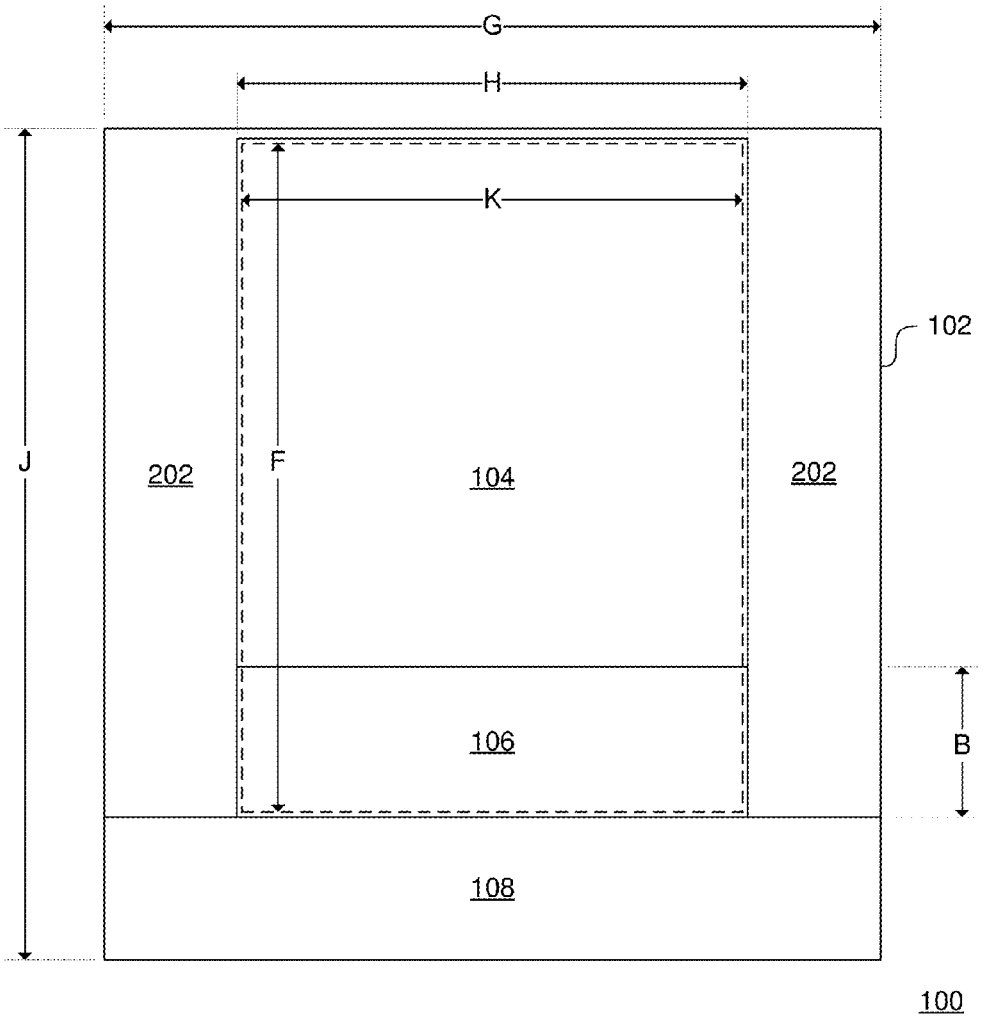
FIG. 2 illustrates a top view of the exemplary bed top covering of FIG. 1.

Referring now to the drawings, wherein like reference numerals designate identical or corresponding parts throughout the several views, and more particularly to FIGS. 1-5 thereof, there is illustrated exemplary bed top sheets, blankets, and quilts, and the like ("bed top coverings") with back-folded and gusseted foot canopies at the bottom thereof. In FIG. 1, the exemplary bed top covering system 100 is shown in a cut away view, and in FIG. 2, the exemplary bed top covering system 100 is shown in a top view. In FIGS. 1-2, the exemplary bed top covering system 100 can include a bed top covering 102 (e.g., made from any suitable material) over a mattress 104, with the bed top covering 102 including a gusseted foot canopy section 106, and a section 108 that can be tucked under the mattress 104.

The back-folded and gusseted foot canopy section 106 can be of a rectangular shape, and configured as a vaulted foot-tent at the bottom portion of the bed top covering 102, as shown in FIGS. 1-2, and generally can be made from the same material as the top portion of the bed top covering, or a lighter material, or a heavier material, or a more flexible material than the rest of the bed top covering 102 depending on climate, seasons, and other factors. Advantageously, the construction of the foot canopy 106 fosters room and maneuverability for the feet. The ceiling height "C" of the foot canopy 106 can be configured to be approximately a foot (e.g., 12") or so to accommodate larger feet. The foot canopy 106 can be made of a traditional sheet fabric or other materials, for example, including sail cloth, parachute material, and the like, that is lighter and fluffier than the rest of the bed top covering 102. Alternatively, the foot canopy 106 can have a roof that is of the same material at the bed top covering 102 but with side walls thereof that offer expandability. The back-folded, non-back-folded, or gusseted foot canopy 106 can also accord warmth and breathability in relatively the same proportion as the bed top covering 102 it is part of. As an example, one would not likely make the gusseted foot canopy 106 out of heavy wool or fur for a light, summery, sheet, blanket, or quilt bed top covering 102. At the other extreme, one would not likely incorporate the gusseted foot canopy 106 out of fine or light silk for a heavier (e.g., flannel) winter sheet or blanket bed top covering 102.

Accordingly, in the example of FIGS. 1-2, the bed top covering 102 can be configured for a standard Queen sized mattress (e.g., 60"×80", dimensions "K"×"F"), can have about the same overall surface area as a standard top sheet for a Queen sized mattress (e.g., 90"×102", dimensions "G"×"J"), and can include the gusseted foot canopy 106 built-in for its ergonomic superiority. Accordingly, the gusseted foot canopy 106 for a Queen sized bed can be approximately 60" wide (dimensions "H") and 14" in width (dimensions "B") with the ceiling height of about 12" (dimensions "C"). Section 108 can include dimensions "D" and "E" that allow the top sheet with the gusseted foot canopy 106 to be tucked around and under the mattress 104 adding up, in the Queen sized bed example, to approximately 14" in total. The dimension marked "E" of the bed top covering 102 can be configured so as to be tucked under the mattress 104 and the dimension "A" can be approximately 74" or so for a Queen sized bed. As shown in FIG. 2, the bed top covering 102 can include side sections 202 that can lay along the side of the bed or that can be tucked in under the side of the mattress 104.

Figure 4:
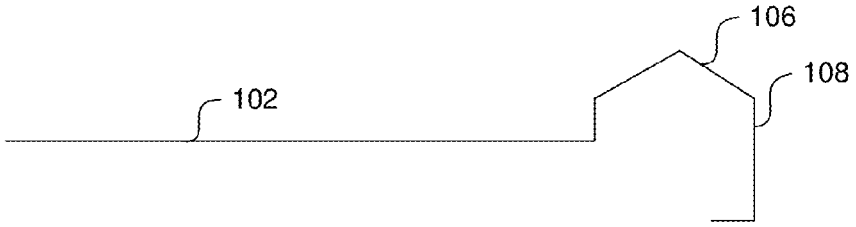
Figure 5:
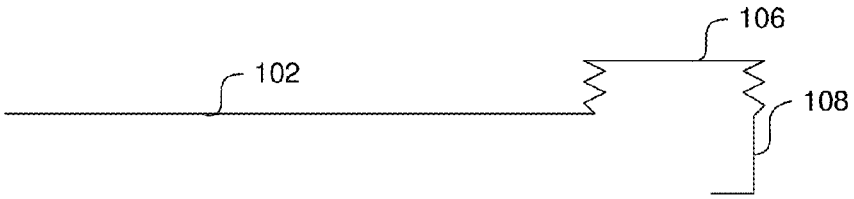

The foot canopy 106 construct can be varied with respect to shape, height, materials, construction, stitching techniques, and the like, based on the teachings of the present invention, as will be appreciated by those of ordinary skill in the relevant art(s). For example, FIGS. 3-5 illustrate further exemplary configurations of the gusseted foot canopy 106 of the bed top covering 102 FIGS. 1-2.

Figure 3:
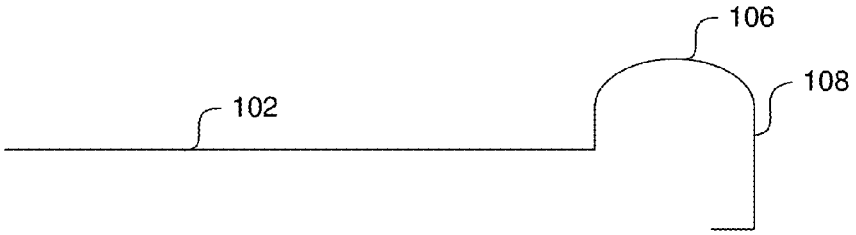
FIGS. 3-5 illustrate further exemplary configurations of the back-folded, non-back-folded, or gusseted foot canopy of the bed top covering FIGS. 1-2.

In FIG. 3, the gusseted foot canopy 106 is shown as being configured to have a round or domed shape. In FIG. 4, the gusseted foot canopy 106 is shown as being configured to have a pointed or roof top shape. In FIG. 5, the foot canopy 106 is shown as being configured to have a flat top with back-folded or accordion shaped sides, which can be included in the configurations of FIGS. 1-4 in further exemplary embodiments. Accordingly, the gusseted foot canopy 106 can be configured in any suitable shape, based on the teachings of the present invention, as will be appreciated by those of ordinary skill in the relevant art(s).

FIGS. 1-5 and the descriptions thereof are to be regarded as illustrative in nature, and not as restrictive as length, width, and height, so that the bed top covering 102 and the foot canopy 106 can be varied particularly depending upon bed size, and the like, based on the teachings of the present invention, as will be appreciated by those of ordinary skill in the relevant art(s). For example, the bed top covering 102 and the gusseted foot canopy 106 can be configured for the exemplary bed sizes and bed top covering types, as shown below:

Mattress Sizes: Twin—39×75 inches (or 99×190 cm); X-Long Twin—39×80 inches (99×203 cm), Full—54×75 inches (137×190 cm); Queen—60×80 inches (or 153×203 cm); King—76×80 inches (or 198×203 cm); California King—72×84 inches (or 182×213 cm).

Fitted Sheet Sizes: Twin—39×75 inches (or 99×190 cm); X-Long Twin—39×80 inches (99×203 cm); Full—54×75 inches (137×190 cm); Queen—60×80 inches (or 153×203 cm); King—76×80 inches (or 198×203 cm); California King—72×84 inches (or 182×213 cm).

Flat Sheet Sizes: Twin—66×96 inches (or 167×243 cm); X-Long Twin—66×102 inches (or 167×259 cm); Full—81×96 inches (or 205×243 cm); Queen—90×102 inches (or 228×259 cm); King/California King—108×102 inches (or 274×259 cm).

Comforter Sizes: Twin—68×86 inches (or 173×218 cm); Full/Queen—86×86 inches (or 218×218 cm); King/California King—100×90 inches (or 254×229 cm).

Although the embodiments described with respect to FIGS. 1-5, are illustrated in terms of being applicable to bed top coverings, the beds themselves can be configured to include a foot canopy, based on the teachings of the present invention, as will be appreciated by those of ordinary skill in the relevant art(s).

Figure 6:
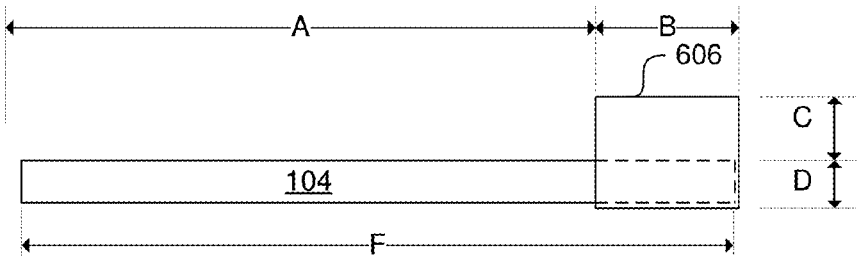
FIG. 6 illustrates a side view of an exemplary foot canopy for a bed.
Figure 7:
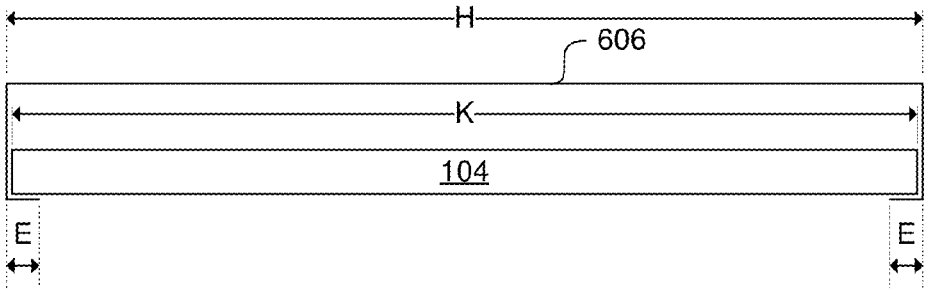
FIG. 7 illustrates a cross sectional width view of another shaped foot canopy for a bed of FIG. 6.

Accordingly, FIGS. 6-10 illustrate an exemplary foot canopy for a bed. The exemplary embodiments of the gusseted foot canopy for a bed of FIGS. 6-10 share many of the features and advantages previously described with respect to FIGS. 1-5 and common features, advantages, details, dimensions, and the like, will not be further described for the sake of brevity. In FIG. 6, the foot canopy system 600 is shown in a cut away view, and in FIG. 7, the foot canopy system 600 is shown in a cross sectional width view. In FIGS. 6-7, the exemplary foot canopy system 600 can include a foot canopy section 606 (e.g., made from any suitable material, such as plastic, wood, cardboard, etc.) and adapted to be removably attached to a bottom portion of the mattress 104, with the foot canopy section 606 including a section shown with dimension "E" that can be tucked or snapped in under the mattress 104.

The gusseted and back-folded foot canopy section 606 can be of a rectangular shape, and configured as a vaulted foot-tent at the bottom portion of the mattress 104, as shown in FIGS. 6-7. Advantageously, the construction of the foot canopy 606 fosters room and maneuverability for the feet. The ceiling height "C" of the expanded foot canopy 606 can be configured to be approximately a foot (e.g., 12") or more to accommodate larger feet and the sheet or blanket material will also allow for further draping over the user's extended feet.

Figure 9:
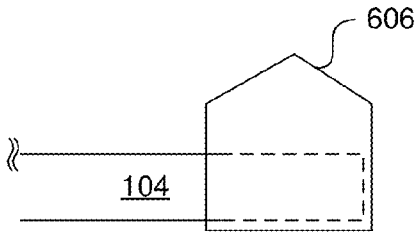
Figure 10:
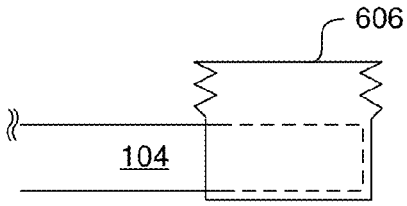

Accordingly, in the example of FIGS. 6-7, the gusseted foot canopy section 606 can be configured for a standard King, Queen, Twin, or any sized mattress, as previously described with respect to FIGS. 1-5. The gusseted foot canopy 606 construct can be varied with respect to shape, height, materials, construction, stitching techniques, and the like, based on the teachings of the present invention, as will be appreciated by those of ordinary skill in the relevant art(s). For example, FIGS. 8-10 illustrate further exemplary configurations of the foot canopy 606 of FIGS. 6-7.

Figure 8:
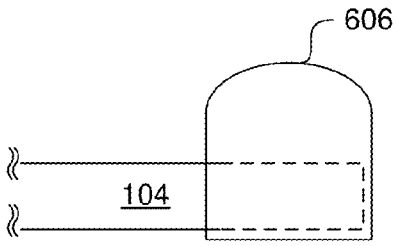
FIGS. 8-10 illustrate further exemplary configurations of the back-folded, non-back-folded, or gusseted foot canopy for a bed of FIGS. 6-7.

In FIG. 8, the gusseted foot canopy 606 is shown as being configured to have a round or domed shape. In FIG. 9, the foot canopy 606 is shown as being configured to have a pointed roof top shape although the canopy itself will often drape over the user's feet as it is constructed from sheet or blanket material. In FIG. 10, the gusseted foot canopy 606 is shown as being configured to have a flat top with back-folded or accordion sides, which can be included in the configurations of FIGS. 6-9 in further exemplary embodiments. Accordingly, the gusseted foot canopy 606 can be configured in any suitable shape, based on the teachings of the present invention, as will be appreciated by those of ordinary skill in the relevant art(s).

FIGS. 6-10 and the descriptions thereof are to be regarded as illustrative in nature, and not as restrictive as length, width, and height, so that the foot canopy 106 can be varied particularly depending upon bed size, and the like, based on the teachings of the present invention, as will be appreciated by those of ordinary skill in the relevant art(s). For example, the gusseted, back-folded, and non-back-folded foot canopy 606 can be configured for the exemplary bed sizes and bed top covering types previously described with respect to FIGS. 1-5.

Figure 11:
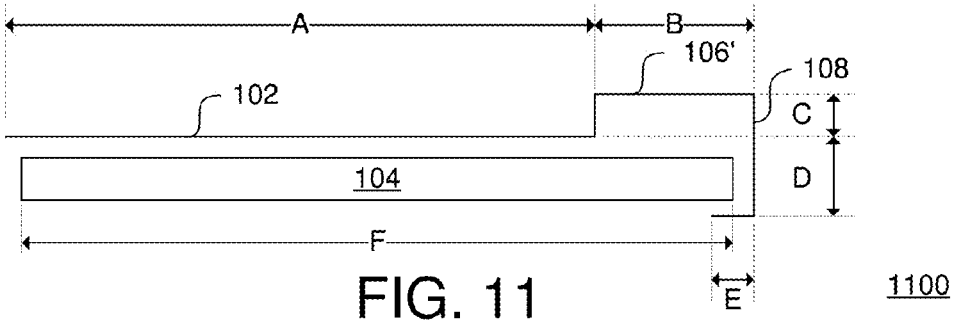
FIG. 11 illustrates a cut away, side view of an exemplary bed top covering with an electrically heated foot canopy denoted by 106 and 108 at the bottom thereof.
Figure 12:
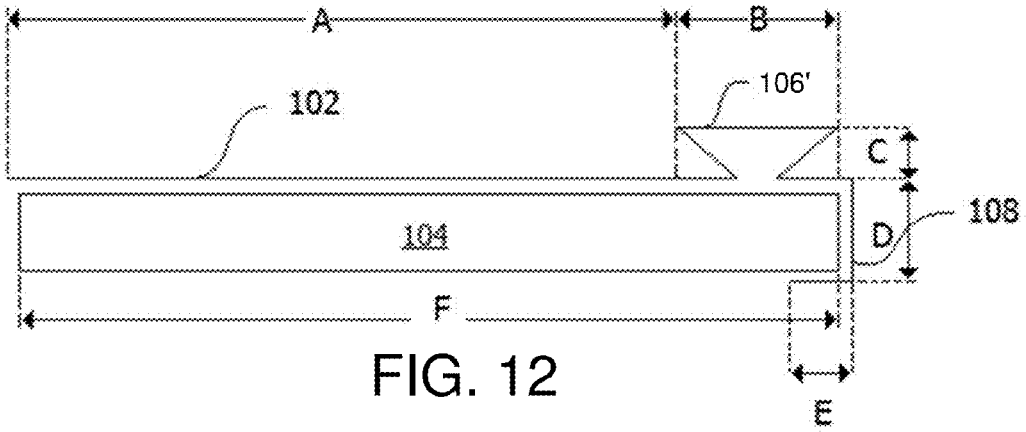
FIG. 12 illustrates a side view of the exemplary back-folded electrically heated foot canopy with the ceiling of the canopy denoted by 106' and the flap to be tucked in and around the mattress at the foot of the bed denoted by 108, as the canopy is designed to be as soft and flexible as possible.
Figure 13:
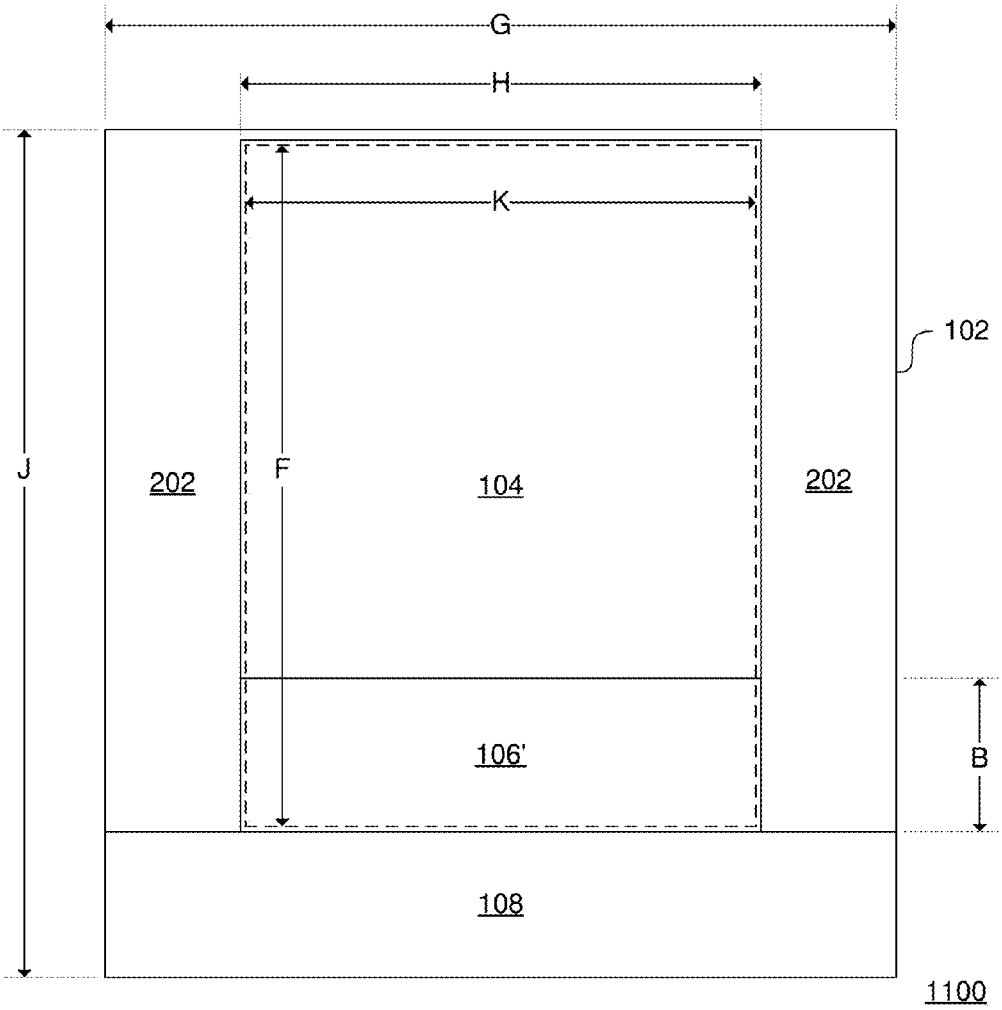
FIG. 13 illustrates a top view of the exemplary electrically heated foot canopy of FIG. 11 with the rectangular when flat ceiling of the canopy denoted by 106'.

FIGS. 11-13 illustrate exemplary bed top sheets, blankets, and quilts, and the like ("bed top coverings") with a back-folded and a non-back-folded electrically heated foot canopy 106' at the bottom thereof and which can be used in the embodiments of FIGS. 1-10. In FIG. 11, the exemplary bed top covering system having electrically heated foot canopy 106' is shown, and in FIG. 12, the exemplary back-folded bed top covering system is shown in a side view. In FIG. 13, the exemplary bed top covering system having electrically heated foot canopy 106' is shown in a top view. In FIGS. 11-13, the exemplary bed top covering system can include a bed top covering 102 (e.g., made from any suitable material) over a mattress 104, with the bed top covering 102 including the electrically heated foot canopy section 106', and a section 108 that can be tucked under the mattress 104 as seen in FIG. 13.

The electrically heated foot canopy section 106' can be of a rectangular shape on the ceiling, and configured as a back-folded foot-tent at the bottom portion of the bed top covering 102, as shown in FIGS. 14-20, and generally incorporates insulated wires or other heating elements woven within the fabric of the ergonomic foot canopy 106' itself or sandwiched like a wafer between two layers of insulation as well as the plush, more decorative exposed bed top covering material. Advantageously, the construction of the back-folded, electrically heated, foot canopy 106' allows it to lay flat when it is not in use and to comfortably extend and drape the feet of a user when the canopy is entered fostering room and maneuverability for his or her feet. The back-folded sides "C" of the canopy 106' can be configured to extend to approximately a foot (e.g., 12") or more based on the height of the back-folded hairpin sidewalls as well as the flexibility or give in the canopy ceiling itself to accommodate, drape, and warm even very large feet. The back-folded, electrically heated, foot canopy 106' of the blanket is also designed to be able to accommodate a conceptually similar ergonomic back-folded (but not heated) foot canopy of a top sheet so a user may lie between the bottom and top sheets on his or her back and have the feet comfortably extended upward under the sheet's back-folded canopy that in turn fits within the back-folded foot canopy of the plain blanket or within the back-folded electrically heated foot canopy of the heated blanket. Accordingly, the entrée to the back-folded foot canopy of the blanket is slightly larger and more open than the entrée to the back-folded foot canopy of the sheet so that the sheet's canopy easily moves inside the blanket's canopy when in use. The back-folded (non-heated) foot canopy of the sheet and non-heated blanket also functions as another layer of insulation from the back-folded electrically heated canopy's wires or heating elements.

Accordingly, in the example of FIGS. 11-13, the back-folded, electrically heated, bed top covering 102 (in essence, 102 is the entire bed covering including Dimensions "A", "B", "C", and "D") can be configured for a standard Queen sized mattress (e.g., 60"×80", dimensions "K"×"F"), can have about the same overall surface area as a standard blanket for a Queen sized mattress (e.g., 90"×102", dimensions "G"×"J"), and can include the back-folded electrically heated foot canopy 106' built-in for its warming and ergonomic superiority. Accordingly, the foot canopy 106' for a Queen sized bed can be approximately 60" wide (dimensions "H") and 22" in width (dimensions "B") with the two 11" back-folded sidewalls (dimensions "C") as well as the flexible canopy ceiling that also has give and can drape over extended feet. Section 108 can include dimensions "D" and "E" that allow the blanket with the back-folded electrically heated foot canopy 106' to be tucked around and under the mattress 104. The dimension marked "E" of the bed top covering 102 can be configured so as to be tucked under the mattress 104 and the dimension "A" can be approximately 74" or so for a Queen sized bed. As shown in FIGS. 12-13, the bed top covering 102 can include side sections 202 that can lay along the side of the bed or that can be tucked in under the side of the mattress 104. The dimensions marked "D" and "E" are for the purpose of tucking the bed top covering in, around and under the mattress; accordingly, dimensions "D" and "E" do not contain wires or heating elements.

Figure 14:
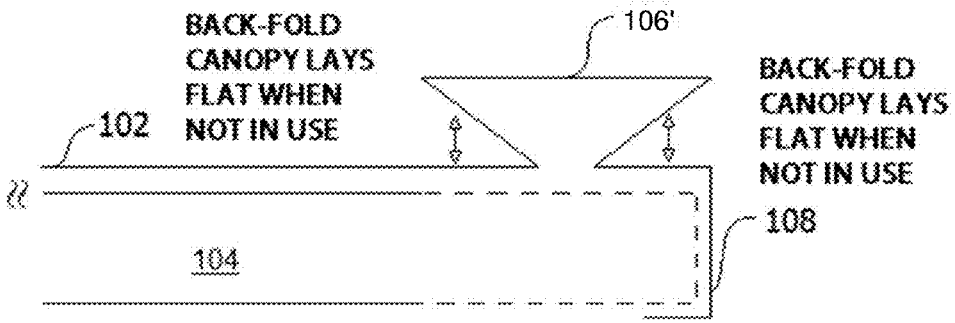
FIGS. 14-20 illustrate further exemplary configurations of the back-folded and non-backfolded electrically heated foot canopies of FIGS. 11-13.

The back-folded electrically heated foot canopy 106' construct can be varied with respect to its shape, height, materials, types of wires and/or heating elements, types of insulation, construction, stitching and weaving techniques, and the like, based on the teachings of the present invention, as will be appreciated by those of ordinary skill in the relevant art(s). For example, FIGS. 14-20 illustrate further exemplary configurations of the back-folded, electrically heated, foot canopy 106' of the bed top covering 102 FIGS. 11-12. Generally, however, in an exemplary embodiment, the canopy's ceiling is rectangular in shape and back-folded in design so it folds/collapses and lays flat when not in use and has room to expand like an accordion section and drape the feet when in use as seen in FIG. 12 and FIG. 14.

Figure 15:
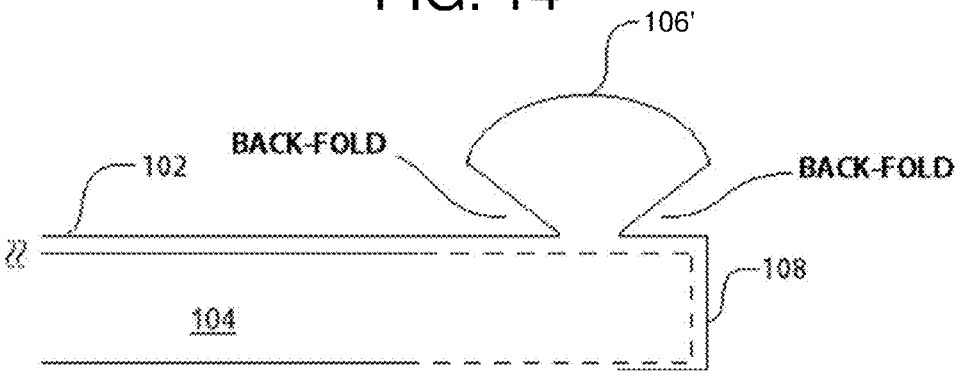
Figure 16:
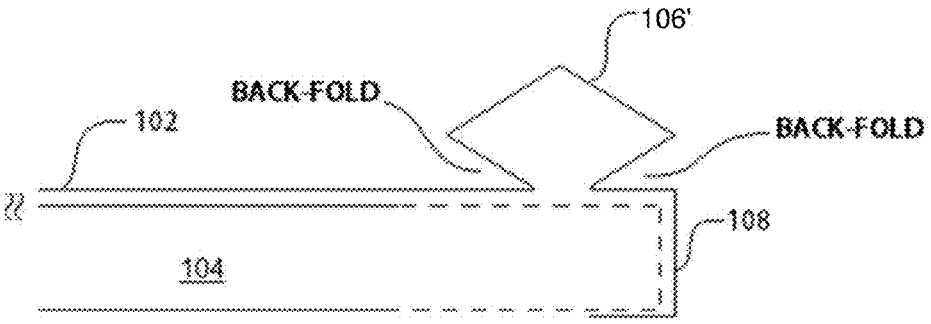
Figure 17:
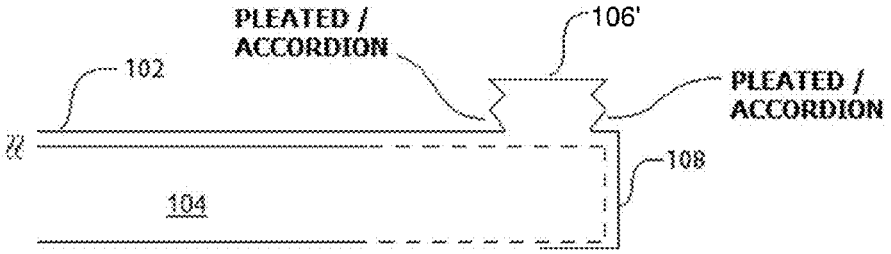
Figure 18:
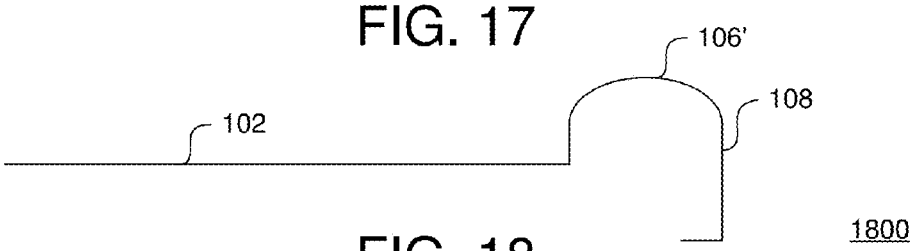
Figure 19:
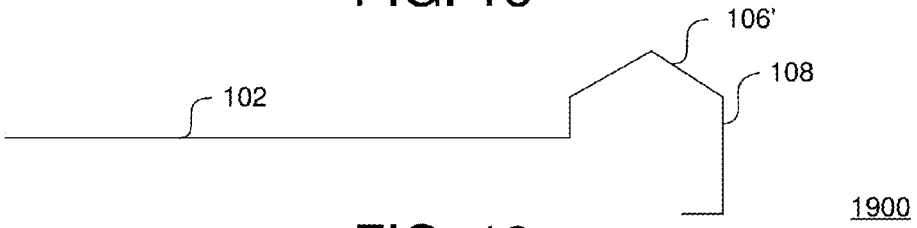
Figure 20:
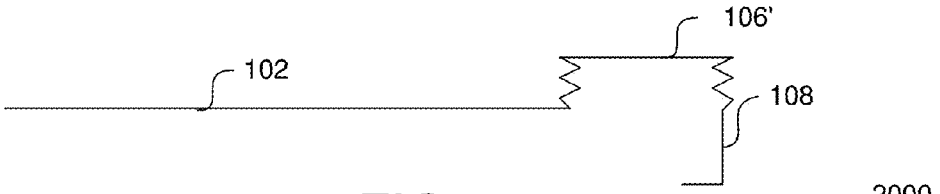

In FIG. 15, the back-folded electrically heated foot canopy 106' is shown as being configured to have a round or domed shape. In FIG. 16, the foot canopy 106' is shown as being configured to have a pointed ceiling top shape. In FIGS. 17 and 19, the electrically heated foot canopy 106' is shown as being configured to have a flat top with pleated accordion shaped sides, which can be included in the configurations of FIGS. 11-13 in further exemplary embodiments. Accordingly, the electrically heated foot canopy 106' can be configured in any suitable shape, based on the teachings of the present invention, as will be appreciated by those of ordinary skill in the relevant art(s).

FIGS. 11-21 and the descriptions thereof are to be regarded as illustrative in nature, and not as restrictive as to length, width, and height, so that the bed top covering 102 and the back-folded electrically heated foot canopy 106' can be varied particularly depending upon bed size, and the like, based on the teachings of the present invention, as will be appreciated by those of ordinary skill in the relevant art(s). For example, the bed top covering 102 and the electrically heated, foot canopy 106' can be configured for the exemplary bed sizes and bed top covering types, as shown below:

Blankets, quilts, and other bed top coverings incorporating the electrically heated foot canopy 106' sizes include: Twin—66×96 inches (or 167×243 cm); X-Long Twin—66×102 inches (or 167×259 cm); Double—81×96 inches (or 205×243 cm); Queen—90×102 inches (or 228×259 cm); King/California King—108×102 inches (or 274×259 cm).

Figure 21:
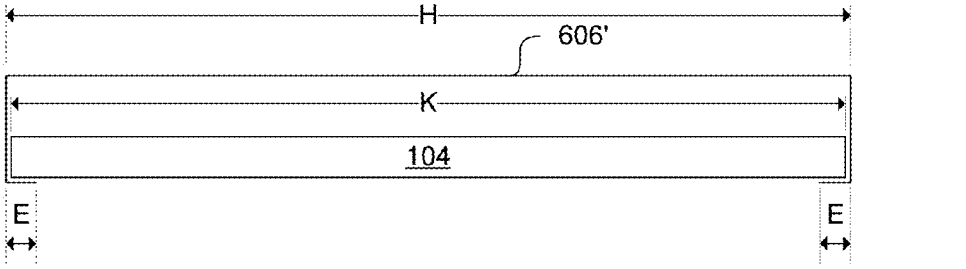
FIG. 21 illustrates a foot of the bed view and how the exemplary configuration can be tucked in around and under the mattress at the sides denoted by "E"
Figure 22:
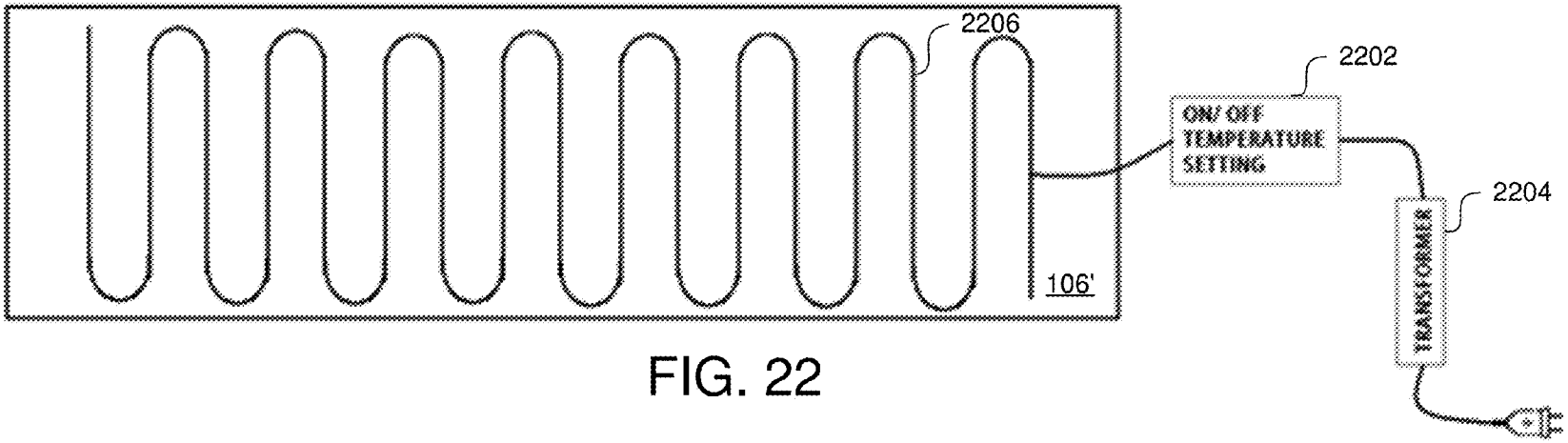
FIGS. 22-35 illustrate a top down inside view of the canopy ceiling 106' of the electrically heated foot canopy of FIGS. 11-13 and exemplary configurations of the heating wires and heating elements whether powered by AC current in FIGS. 22-29 or by rechargeable batteries in FIGS. 30-35.
Figure 23:
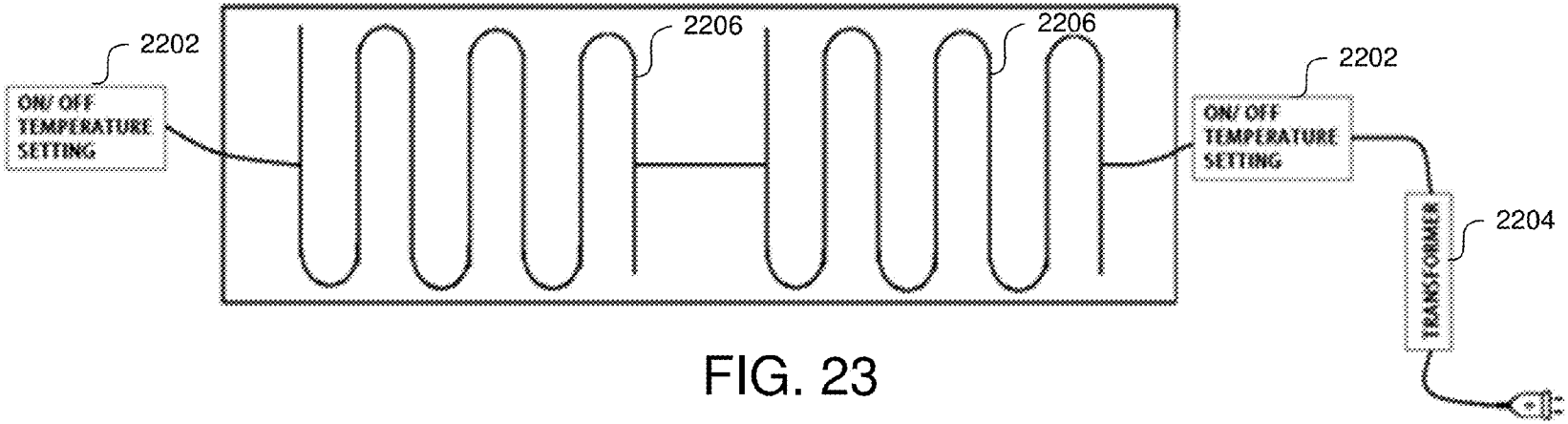
Figure 24:
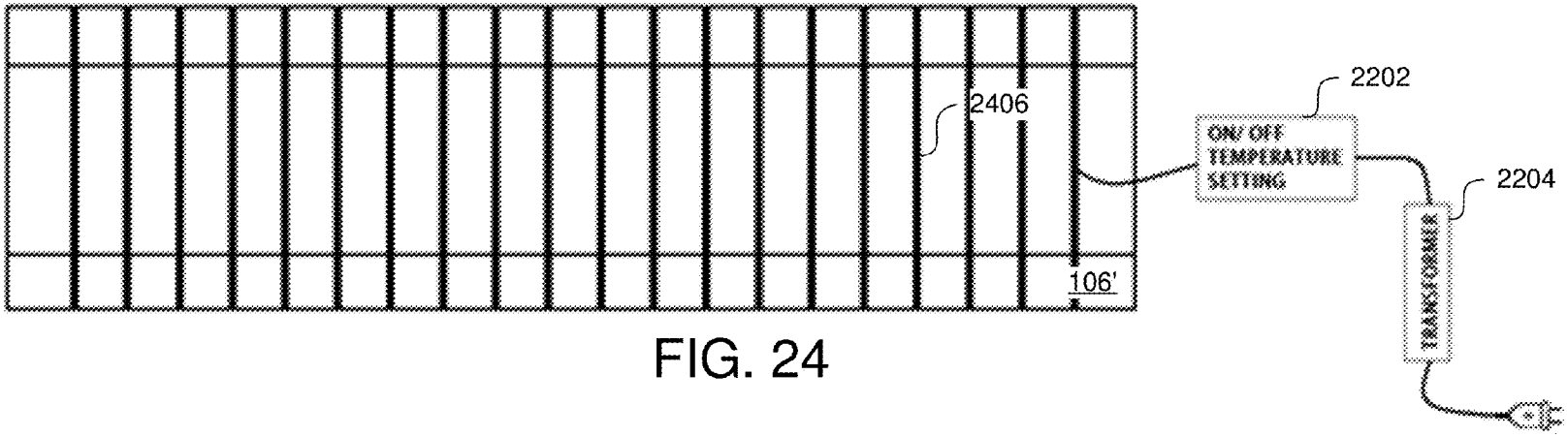
Figure 25:
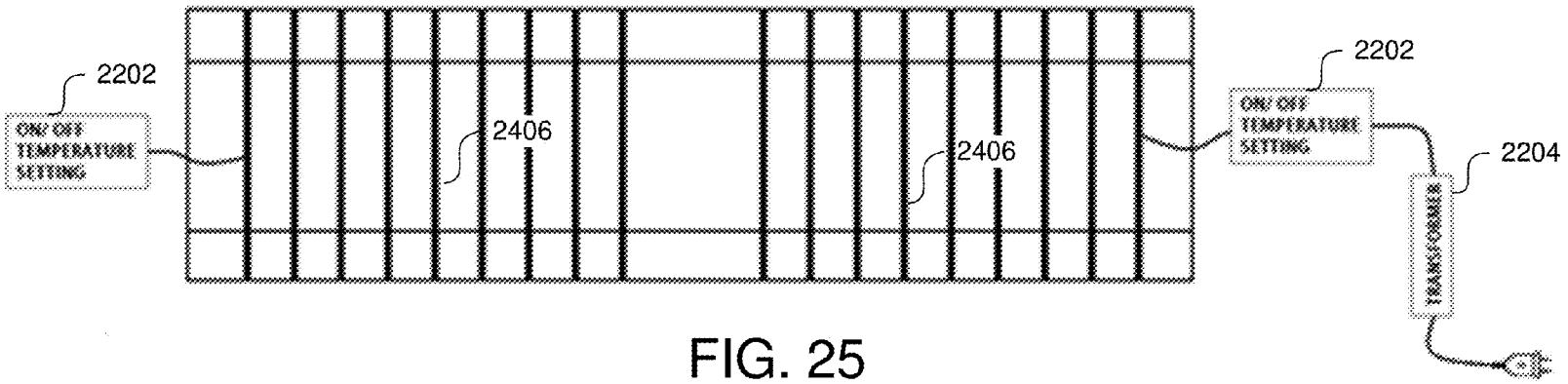
Figure 26:
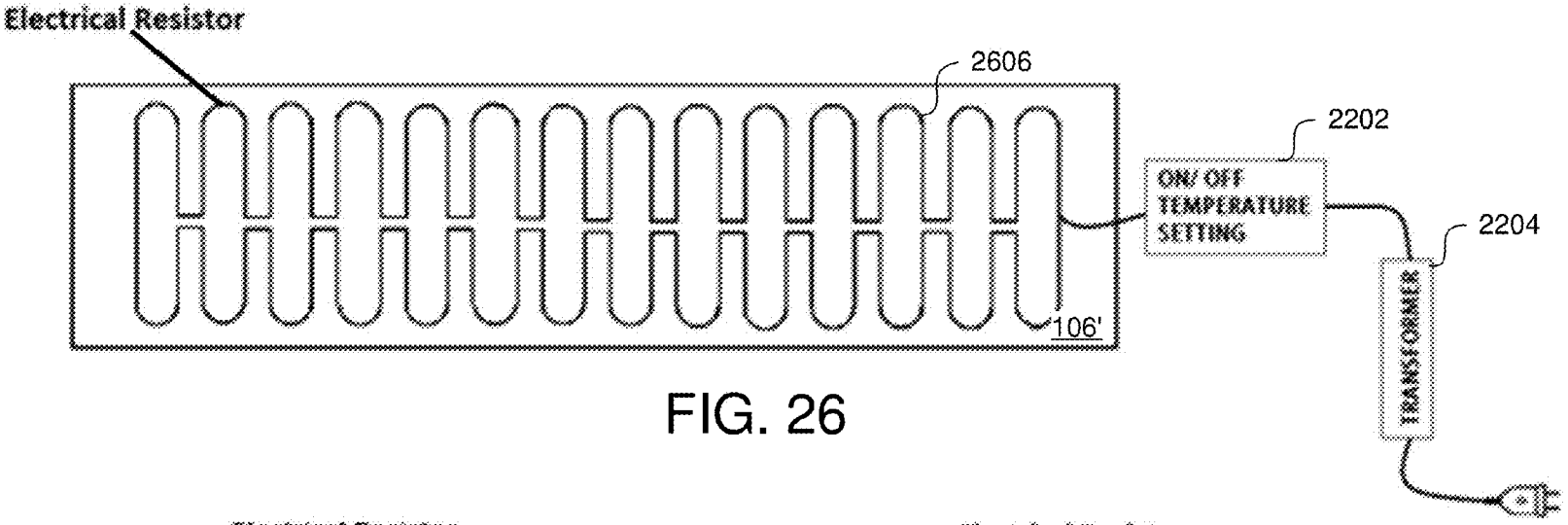
Figure 27:
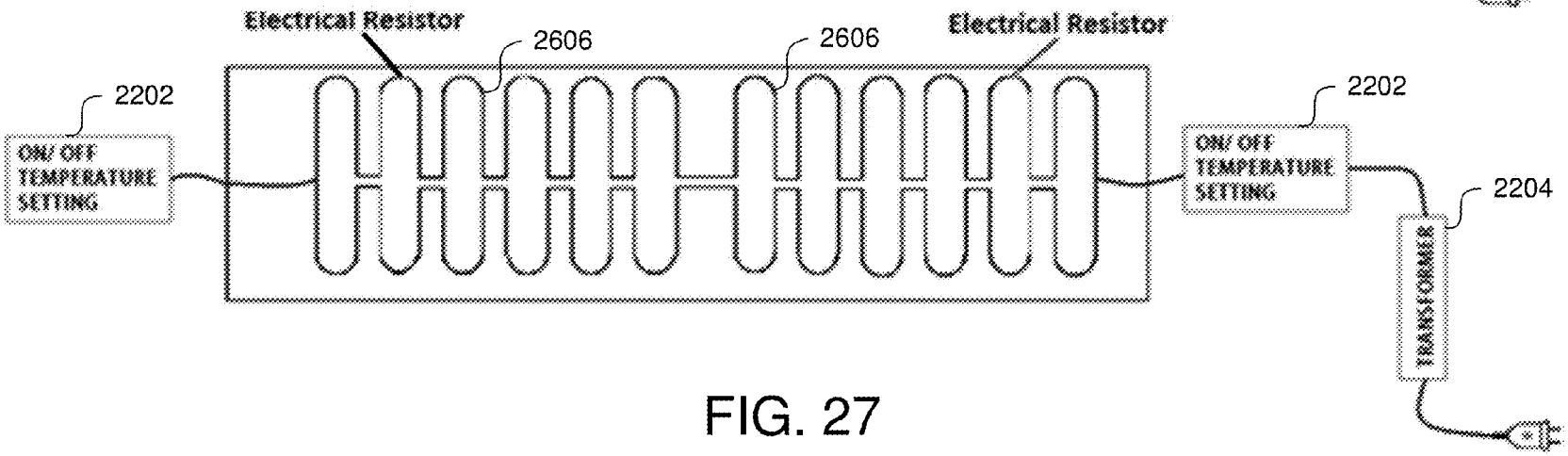
Figure 28:
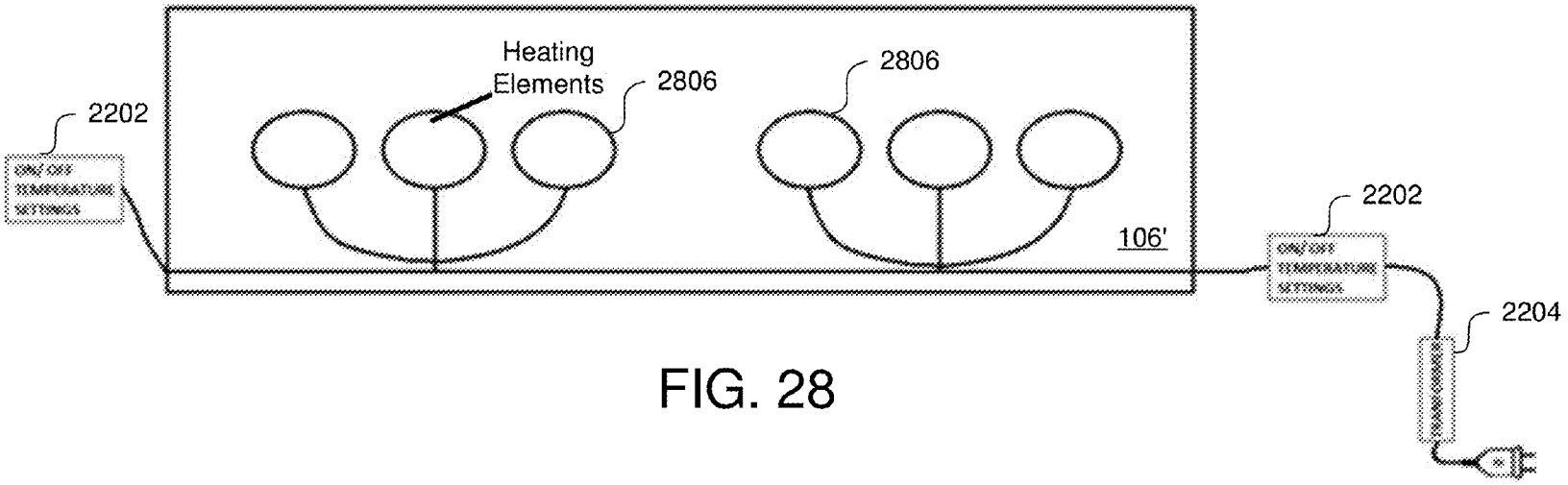
Figure 29:
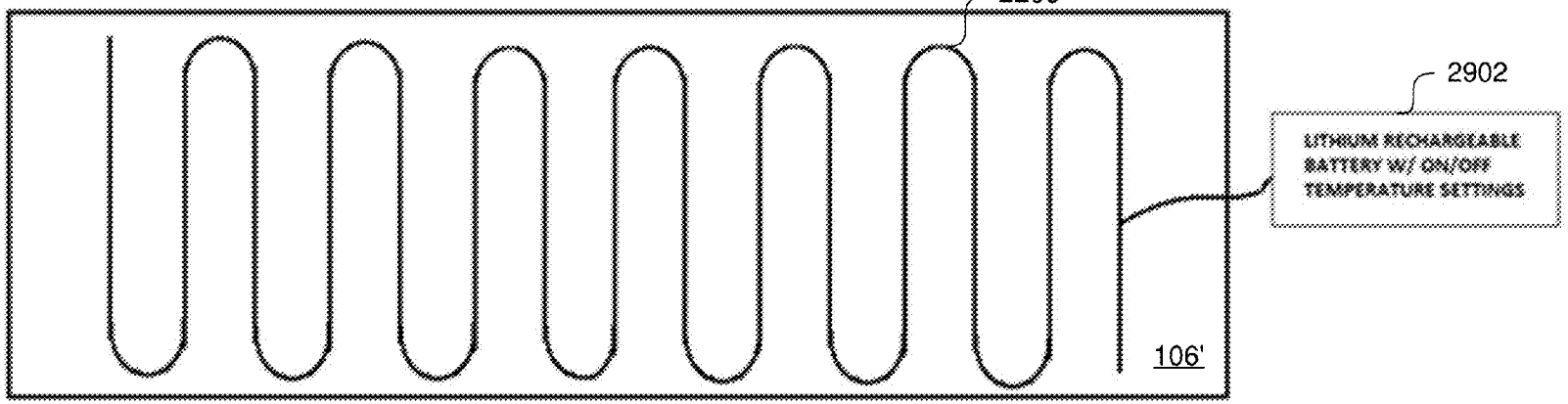
Figure 30:
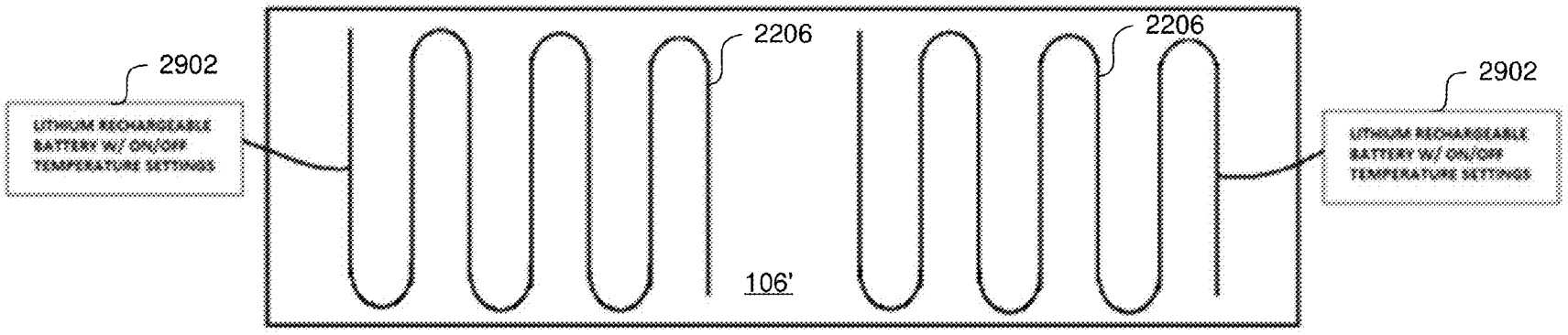
Figure 31:
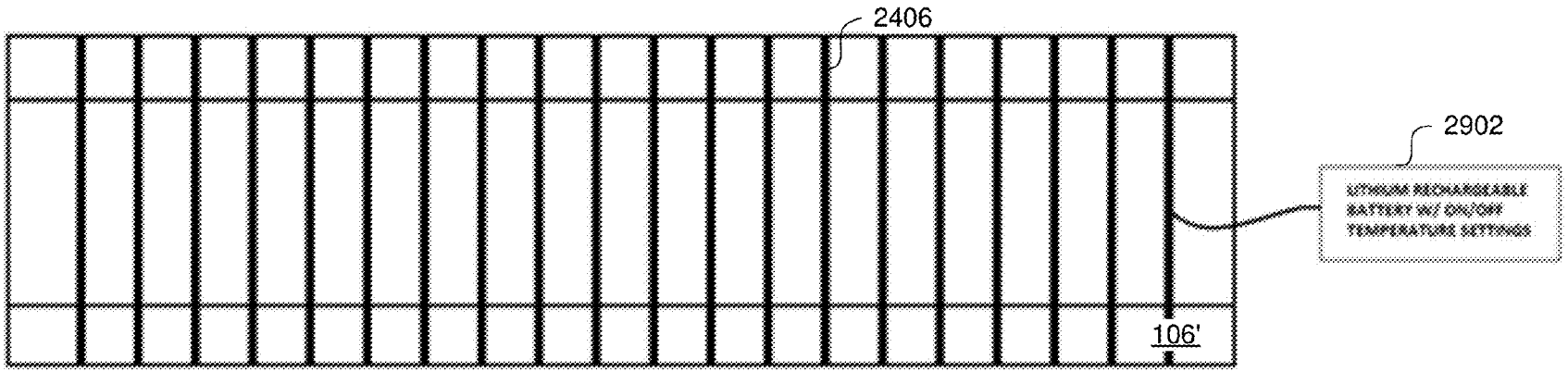
Figure 32:
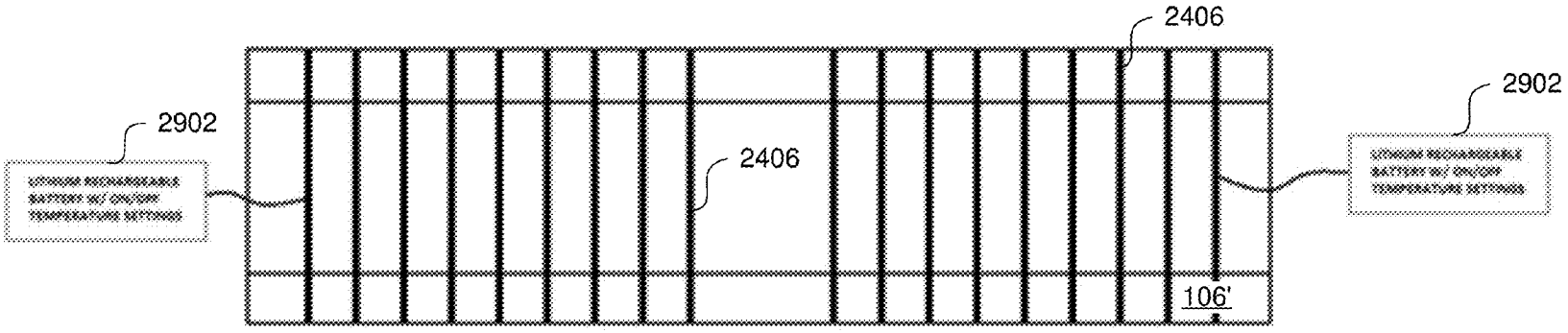
Figure 33:
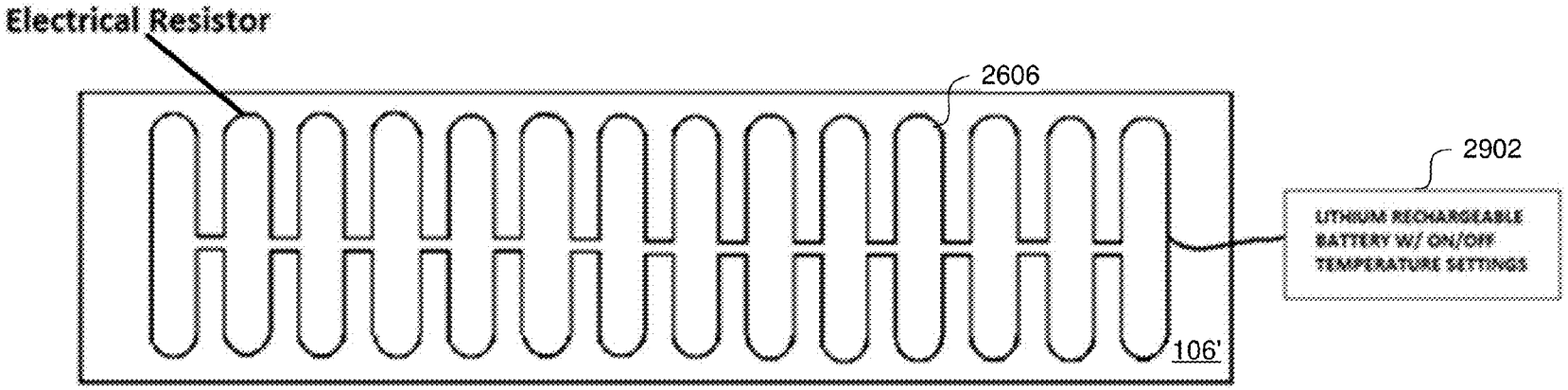
Figure 34:
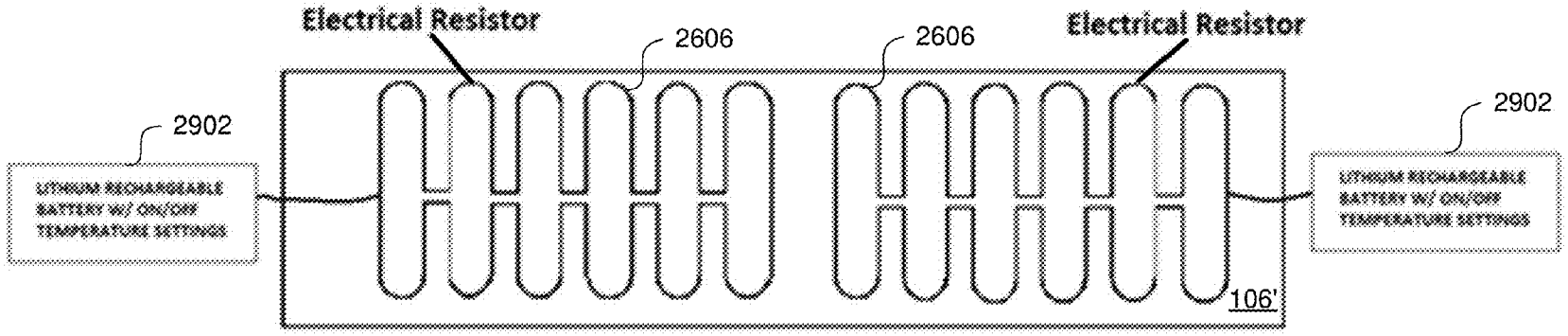
Figure 35:
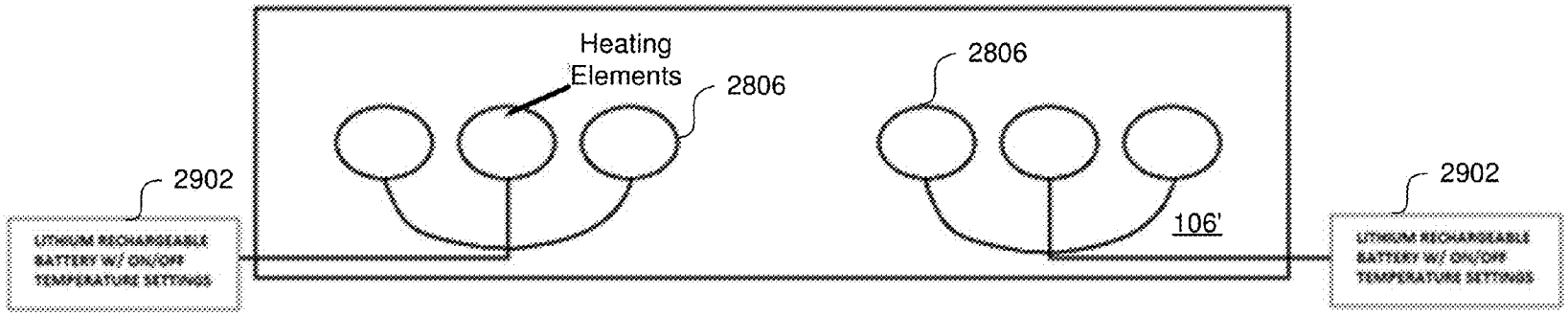

FIG. 21 illustrates a foot of the bed view and how the exemplary configuration can be tucked in around and under the mattress at the sides denoted by "E". FIGS. 22-28 illustrate different configurations of wires or heating elements 2206, 2406, 2606, and 2806 within the ceiling of the electrically heated foot canopy 106' and the use of AC power from an electrical outlet. There are separate controllers 2202 for each user to turn on and off the heat as well as set the temperature. There is also displayed the use of a transformer 2204 to reduce the wattage when a plug is used for the AC outlet. The transformer 2204 may be built in to the controllers 2202.

FIGS. 29-35 illustrate different configurations of wires or heating elements 2206, 2406, 2606, and 2806 within the ceiling of the electrically heated foot canopy 106' and the use of rechargeable batteries 2902 with heat level settings to power the heating wires and elements 2206, 2406, 2606, and 2806 on each side of the foot canopy 106' (each side of the bed).

Figure 36:
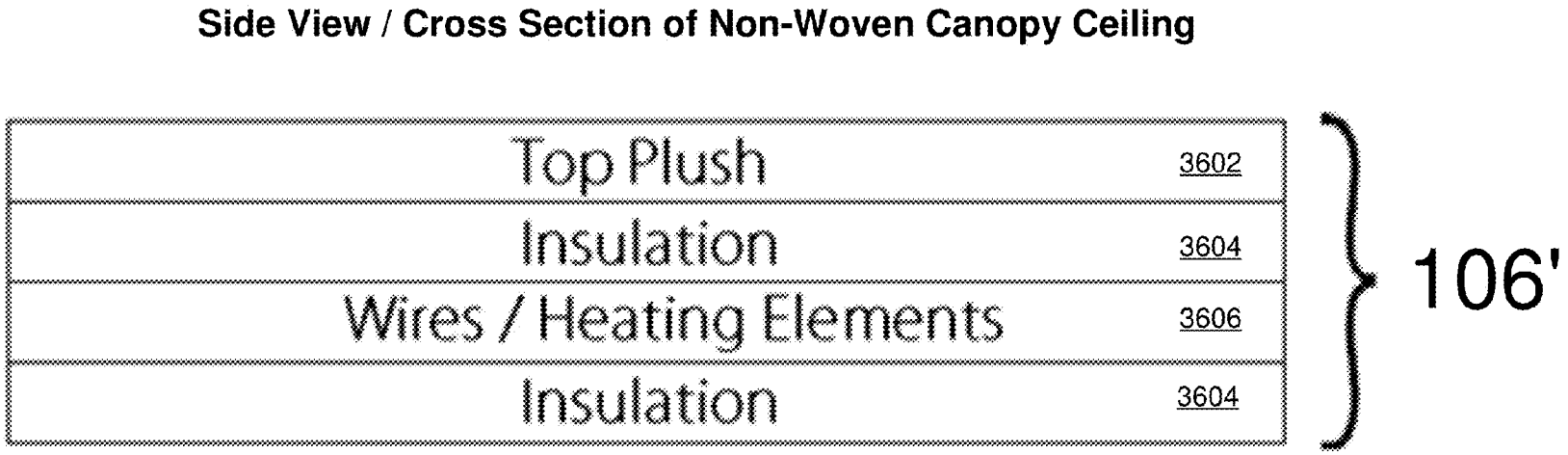
FIG. 36 illustrates that the ceiling of the canopy can also be a wafer configuration versus having the very thin heating wires or heating elements woven into the top covering material, the wafer configuration can be made of: (i) the plusher and more decorative blanket or bed top covering material on the outside; (ii) a top insulation layer; (iii) the wires and/or heating elements; and (iv) a lower insulation layer.

FIG. 36 illustrates that in some embodiments instead of the insulated wires or heating elements 3606 being woven within the fabric of the ergonomic foot canopy 106' itself, they may be sandwiched like a wafer between two layers of insulation 3604 as well as the plush, more decorative exposed bed top covering material 3602.

Although the embodiments described with respect to FIGS. 11-36, are illustrated in terms of being applicable to bed top coverings, the beds themselves can be configured to include an electrically heated foot canopy 106', based on the teachings of the present invention, as will be appreciated by those of ordinary skill in the relevant art(s).

In another exemplary embodiment, the foot canopy or the electrically heated foot canopy with the features from FIGS. 1-36, as described, can be configured to be included in sleeping bags, sleep sacks, sleep liners, and the like. Accordingly, the sleeping bags can include an expandable foot canopy, as described with respect to FIGS. 1-36, that can be extended to add ergonomics to the sleeping bags so that a user can recline on their back with room to allow the feet of the user to naturally remain at a right angle.

A sleeping bag is a protective "bag" for a person to sleep in, essentially a blanket that can be closed with a zipper or similar means, and functions as a bed in situations where a bed is unavailable (e.g., group sleep overs, camping, hiking, hill walking, or climbing). Its primary purpose is to provide warmth and thermal insulation. It also protects, to some extent, against wind chill, precipitation, and exposure to view, although a tent performs those functions better. Sleeping bags generally come in two forms: a rectangular sleeping bag and a mummy bag. Sleeping sacks and sleeping bag liners (also referred to herein as "sleeping bag(s)") are lightweight and are sometimes used alone or in conjunction with rectangular and mummy sleeping bags to enhance hygiene and/or warmth.

The classic rectangular sleeping bag is designed for simplicity in folding, rolling up for travel and storage, and providing basic protection from the elements including warmth. The rectangular sleeping bag is formed by folding a square, unitary, quilt-like structure in half and then stitching the feet and utilizing a zipper along the side; or, alternatively, a zipper may be utilized on 3 of its sides of the quilt-like structure so that it can be zipped up all around to form the bag or totally unzipped and utilized as a blanket.

The rectangular sleeping bag is packed up by being folded in half again or folded in thirds, rolled up, and bound with straps or with cords that have cord locks. Classic background art rectangular sleeping bags works well for light camping involving the car, beach, or backyard, as well as for sleepovers, road trips, and overnights in a cabin. They usually are inadequate under more demanding circumstances.

A subset of the classic rectangular sleeping bag is the indoor sleeping bag, sometimes called a slumber bag. Slumber bags are usually not designed to be weatherproof and are often made of natural fabrics, such as cotton, instead of the synthetic fabrics commonly used for outdoor sleeping bags. Children's slumber bags, in particular, often feature elaborate, brightly colored printed designs, such as images of popular media characters. Slumber bags make floor sleeping more comfortable, and are used for sleepovers, family visits, and other situations where there are not enough beds for everyone.

Sleeping bags can also be configured as higher-end, far-more-structured, tapered, and warmer sleeping bags referred to as "mummy" bags. Mummy bags differ from the far simpler rectangular sleeping bags in a number of ways. They taper from the head end to the foot end, reducing their volume and surface area, and improving their overall heat retention properties. Most mummy bags do not unzip all the way to the feet, because the zipper is a weak point in any sleeping bag's insulating qualities. Because of their structure, mummy bags frequently cannot be folded and rolled up like a rectangular bag. Instead, they are literally stuffed into a storage "stuff" sack sometimes called a compression sack. Mummy bags are designed to be used in far colder and more extreme weather conditions and often without a tent.

However, conventional sleeping bags do not incorporate an expandable canopy for the feet. Such expandable canopy lies flat and unobtrusive when not in use. Users who are preparing to recline in the sleeping bag on their back can unfasten and release the expandable foot canopy and immediately improve the ergonomics, so that their feet can maintain their natural right angle when they lie on their back. This is far more comfortable than the current status quo where a user who is on his or her back has to point the toes or turn the feet outward to escape the tightness at the bottom of the bag. If for whatever reason—including they are simply going to lie sideways and go to sleep—users do not feel they need the improved comfort at that time, they can simply leave the canopy fastened and secure.

Rectangular sleeping bags are either stitched shut at the feet or are closable with a zipper at the feet which, for all ergonomic intents and purposes, is as tight and inflexible as regular stitching when it is zipped. The foot canopy addition makes such bags far more ergonomically comfortable for the feet than the conventional rectangular sleeping bag.

Background art mummy bags are tapered and stitched at the bottom. Their side zipper tends to be shorter, as a longer zipper around the feet serves as a weak spot in terms of both weatherproofing and temperature insulation. Mummy bags fall into two general groups regarding ergonomics for the feet: those without a foot box and those with a foot box. In the former, the mummy bag makes no concession whatsoever for the natural right angle of the feet. Accordingly, the feet are terribly inhibited as the bag's natural tapering has already reduced the room at the foot of the bag. The other group of mummy bags does take the feet into account by creating a quazi-foot box at the bottom. While this foot box provides room, if it is done with sufficient space for a normal-size man, it makes the mummy bag rather massive so that it resembles a sarcophagus or even a kayak from a side view perspective. This large, canoe-like structure makes it virtually impossible to fold and roll, let alone stuff in a sack, and thus that much more difficult to pack and manage. The current invention allows the mummy bag to taper on the top (and not just on the sides) and yet have plenty of room for the feet to maintain their natural right angle when the canopy is expanded.

The ability of the current invention's canopy to expand ad hoc offers enormous ergonomic and traveling flexibility. A positive attribute of a conventional rectangular sleeping bag is it is very neat to fold in half and then roll up. The current invention when incorporated in a rectangular sleeping bag directly mimics the rectangular sleeping bag's positive folding attribute. The collapsed, unexpanded canopy lies flat when not in use, preserving all of the classic rectangular sleeping bag's folding and rolling properties and advantages.

In the case of the mummy bag, which is already a nightmare to fold and instead must literally be stuffed in a travel "stuff" sack, the retractable canopy can significantly reduce the bag's profile at the feet. The current invention also allows many, except the most extreme-weather-conditions-focused mummy bags, to be far sleeker and lower profile. For the other more extreme-condition-focused mummy bags with a foot box, the current invention can still have a profound effect on the size and shape of the lower bag, in terms of its tapering and profile. In many cases, the current invention obviates the need for any foot box except in the most extreme cases.

Almost by definition, sleeping bags are used in uncharacteristic locations; and, in the case of a mummy bag, often outdoors, on unfamiliar terrain that could be uneven and mottled by sticks, rocks, snow, ice, or other debris. So for a user, having to fight his or her way out of the sleeping bag to stand and walk off a cramp is not always an easy thing to do. Anecdotally, having to leap out of either a conventional rectangular sleeping bag or mummy sleeping bag to stand up and walk off a cramp in the calf or foot that was engendered by being forced to point the toes because the sealed background art bag is too tight at the feet is even more unwieldy than having to leap out of a normal bed to walk off a cramp. Said differently, to the extent ergonomic improvements, such as accorded by this invention can fend of potential cramping when in a sleeping bag, the better off you are.

The ability to expand the canopy ad hoc also provides flexibility in regulating warmth. Extending the canopy affects the sleeping bag's aerodynamics which could lead to it being less warm, as more surface area is exposed. Depending upon the circumstances, this is either a positive or a negative. But the invention does add great flexibility to a sleeping bag. Elaborating, there may be extreme conditions where the user may determine not to use the canopy at all, as the ambient air is frigid. Alternatively, expanding the foot canopy could moderate the temperature resulting in a more comfortable bag, as being sheathed in a down-filled condom is not always a comfortable experience.

The electrically heated embodiments address colder temperatures more directly. Whether it is adding more warmth during a recreational sleepover with a rectangular sleeping bag, for example during a chilly night at the neighbor's, or coping with frigid temperatures in a mummy bag out in the wilderness, the electrically heated canopy is a wonderful asset to have on top of the room for the feet. The heating elements in the sleeping bag's ergonomic canopy can be used ad hoc to regulate the warmth depending on circumstances.

Depending upon the type of sleeping bag and conditions the sleeping bag is seeking to address, the controls for the heater can be located in ergonomically advantageous places, so that the heating elements can be turned on, turned off, or regulated by the hand without having to unzip the sleeping bag and get out. The current invention's expandable canopy can be made out of the same outer materials and fill as the outside bag; or, it may utilize different materials to make it more or less breathable, warmer, water repellant, etc. The canopy can intentionally be colored differently or incorporate different graphics to stress the ergonomics for the feet.

The bottom of a sleeping bag typically does not provide significant insulation, because body weight crushes the loft of the insulation material. In fact, some sleeping bags do not include any insulation on the bottom at all. Due to this, it is often necessary to use a pad or other less crush-able insulation underneath the sleeper, especially in cold weather. Sleeping bags incorporate a sleeve for holding a sleeping pad, and which can be used with the present invention.

Sleeping bag liners and sleep sacks are essentially a large sheet sewn up like a sleeping bag. They come in rectangular or mummy shapes to fit comfortably within the respective style sleeping bag. Some come with pillow compartments, and some don't. They are occasionally required by hostels, but are also useful in any facility where you might not trust the cleanliness of the sheets. They are also a very nice luxury when compensating for a cheaper hotel with pilled or threadbare sheets. Sleep sacks are often a superior substitute for blankets on long-haul airplane flights. Not only are they warmer, but they offer more privacy. Sleep sacks are also useful when stranded overnight at an airport. They act as a portable "sleeping bag" when no beds are available.

The conventional travel sheet is made from very thin material, often silk, that is sewn together like a sleeping bag. It too may have an attached pillow pocket that keeps the pillow from escaping when sleeping in strange positions in strange locations such as airport benches, airplane seats, and even sagging cots. The liner is generally a rectangular shape to maximize room. It is the same size as a single sized mattress. The thin silk allows the travel sheet to be cool in warm conditions and warm in cool conditions. In cool weather, it adds several degrees of warmth to a sleeping bag. The silk material also makes washing the liner easy. Due to the thinness of the material, it dries in just a few hours. The material also allows the liner to roll up very small—about the size of a fist.

The present invention can be integrated into conventional sleeping bag liners, sleep sacks, travel sheets, and the like, to add ergonomics, so that when any of them are used in conjunction with a sleeping bag of the current invention, their ergonomic canopy can expand to fit right within the outer canopy of the sleeping bag.

Figure 38:
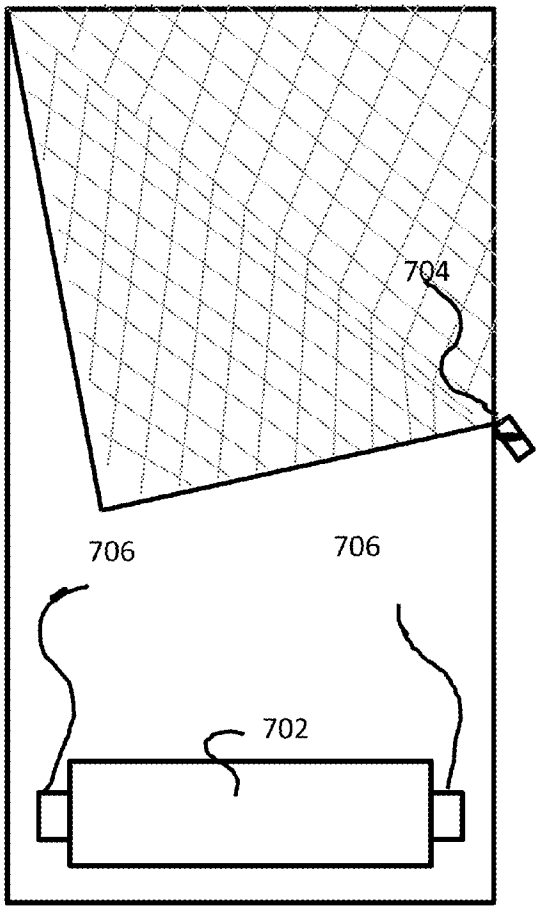
FIGS. 37-38 illustrate a top view of exemplary configurations of a rectangular sleeping bag with an ergonomic canopy at the feet in both zipped and unzipped states.
Figure 37:
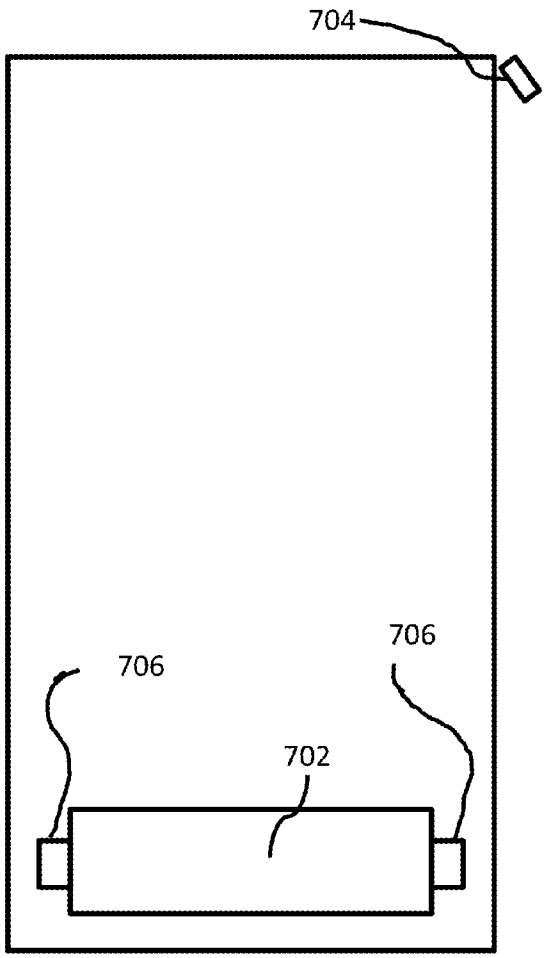

Accordingly, FIGS. 37-38 are a top view of an exemplary configuration of the ergonomic canopy 702 at the foot of a rectangular sleeping bag. The canopy 702 can include any suitable features, as described with respect to FIGS. 1-16. The canopy 702 dimensions can extend and vary greatly to accommodate different size people, as well as to account for different methods for allowing the canopy to expand, as discussed above. Two potential places where the canopy can be fastened by Velcro, snap, button, or any other means are highlighted by 706. Certainly, where the fasteners reside and how they function can vary greatly based on design, decorations, etc. Element 704 highlights the side zipper which in FIG. 37 is in a closed, zipped-up position, and in FIG. 38 is in more of an open, unzipped position.

Figure 40:
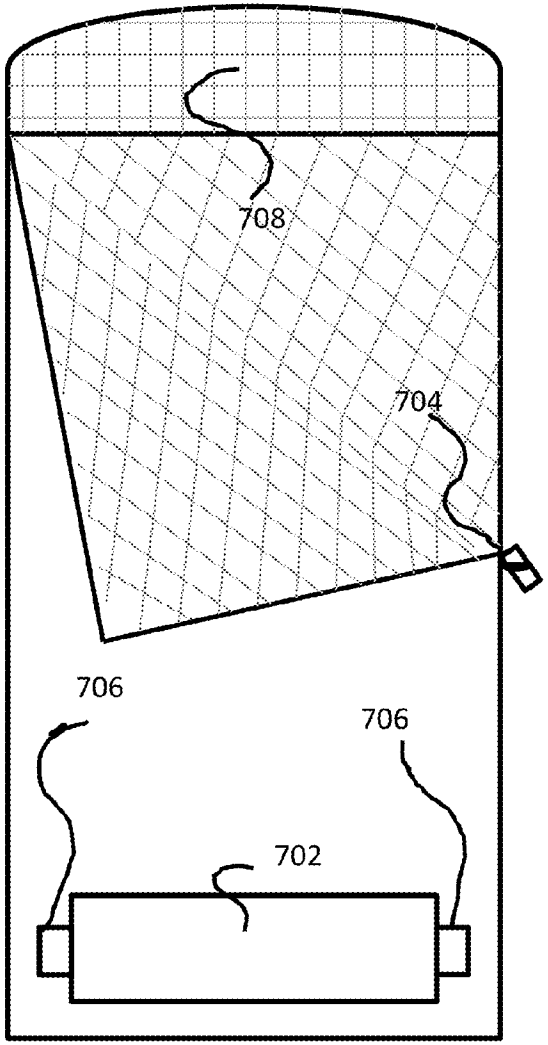
FIGS. 39-40 illustrate a similar top view as in FIGS. 37-38, but with the exemplary configurations having an additional head flap that functions as a pillow.
Figure 39:
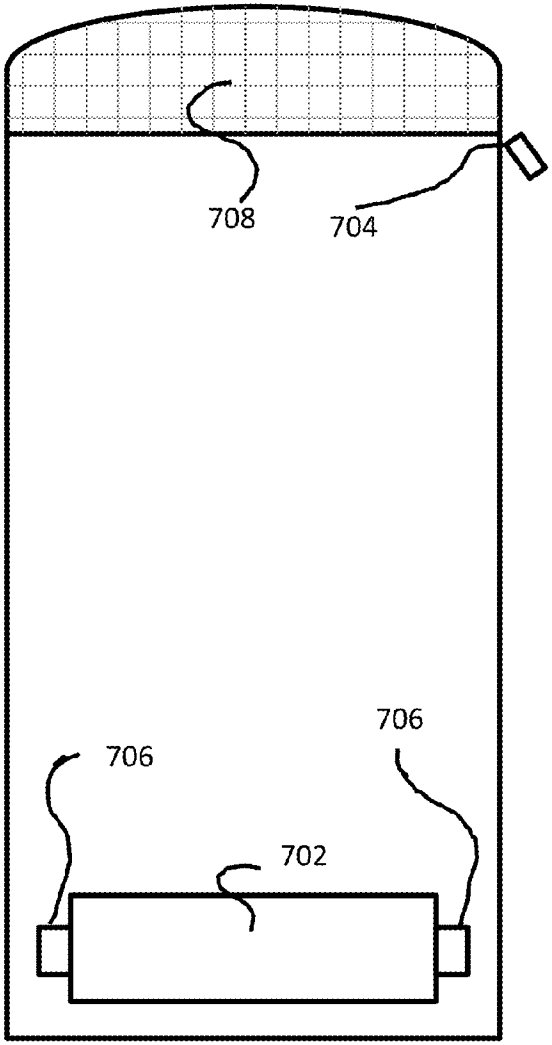

FIGS. 39-40 illustrate the same top view as FIGS. 37-38 with the addition of head flap 708 that functions as a quazi-pillow and insulates the head from direct contact with the ground.

Figure 41:
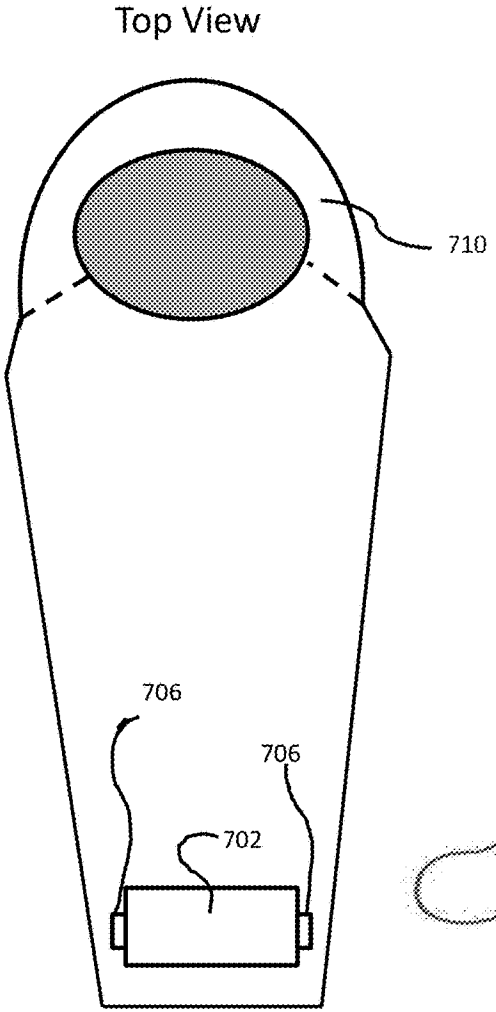
FIG. 41 illustrates a top down view of an exemplary configuration of the more tapered and structured 'mummy' sleeping bag with its draw-cord hood and the ergonomic foot canopy.

FIG. 41 is a top view of an exemplary configuration of the more tapered and structured "mummy" bag with the ergonomic canopy 702. Possible exemplary fastener placement positions are shown by 706, although these could vary greatly. Element 710 highlights a draw-cord hood.

Figure 42:
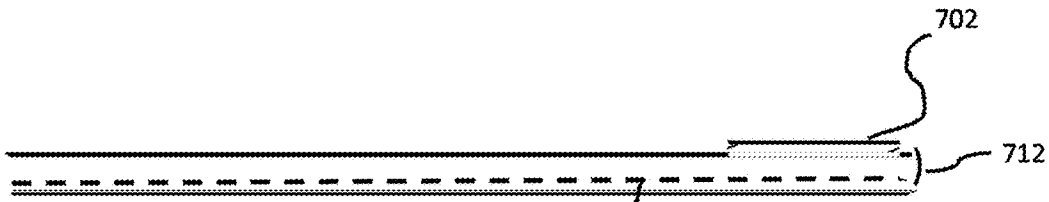
FIGS. 42-44 illustrate a side view of exemplary configurations of a rectangular sleeping bag as the ergonomic canopy expands from a closed position and accommodates the feet of a user.
Figure 43:
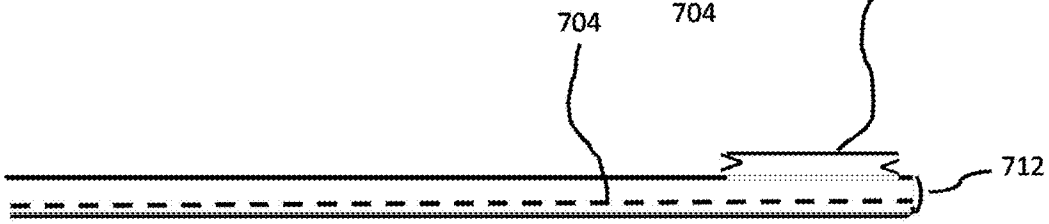
Figure 44:
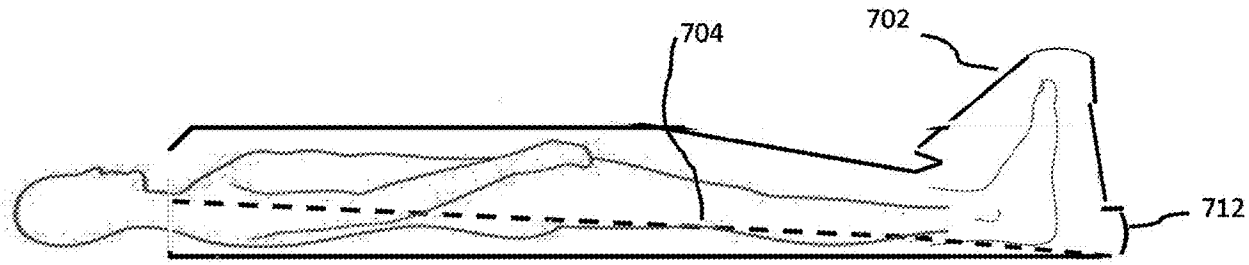

FIGS. 42-44 are a side view of an exemplary configuration of a rectangular sleeping bag with the ergonomic canopy 702 fastened down in FIG. 42, released in FIG. 43, and expanded and in use in FIG. 44. The zipper, which could also run across the bottom of the bag and not only the side is highlighted by 704. Element 712 is not at all to scale as it highlights where the bottom of the rectangular bag is stitched together or alternatively held together by the zipper. As highlighted in FIGS. 17-20, the retractable ergonomic foot canopy may be designed in all kinds of different sizes and shapes.

Figure 45:
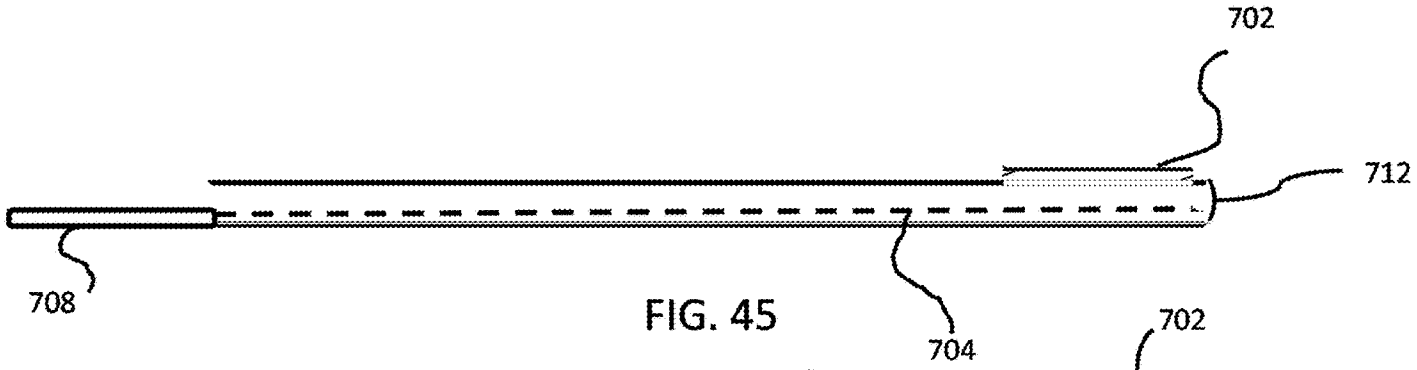
FIGS. 45-47 illustrate a similar side view of exemplary configurations as shown in FIGS. 42-44; however, in these figures, the ergonomic canopy expands in a rectangular sleeping bag with a head flap.
Figure 46:
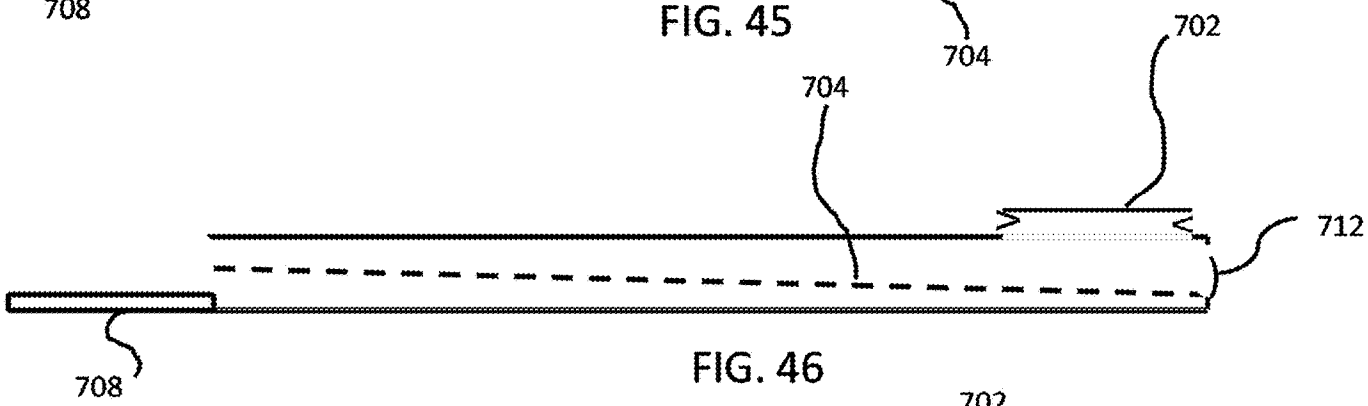
Figure 47:
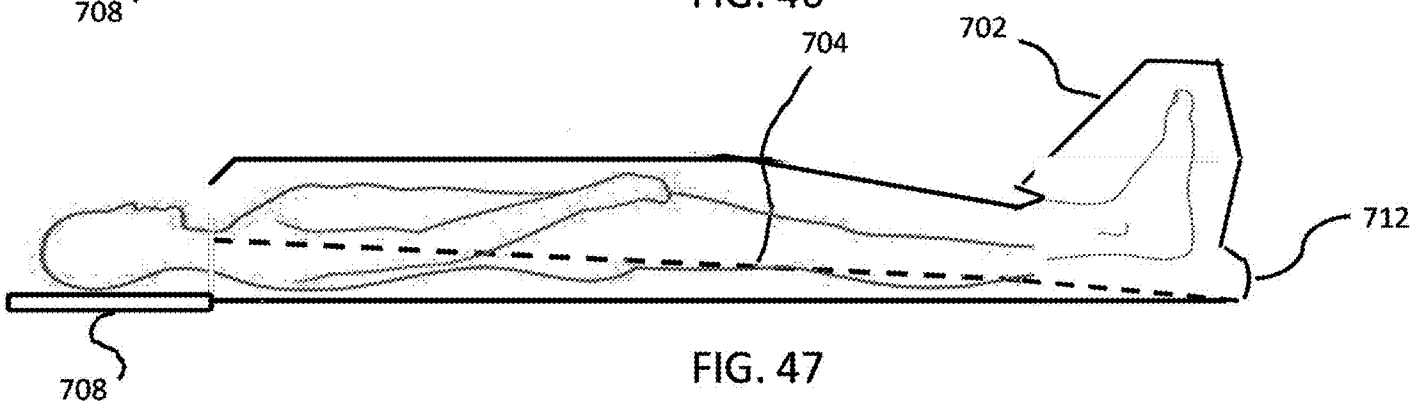

FIGS. 45-47 are side views of the same exemplary configurations shown in FIGS. 42-44 with the inclusion of a head flap for insulation and separation from the ground highlighted by 708.

Figure 48:
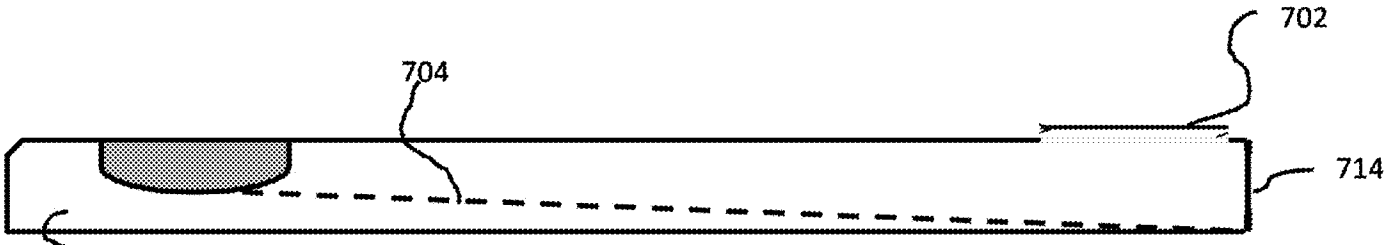
FIGS. 48-50 illustrate a side view of the exemplary configuration of the ergonomic canopy in a mummy bag as it moves from a fastened down position in FIG. 48 to its extended position in FIG. 50.
Figure 49:
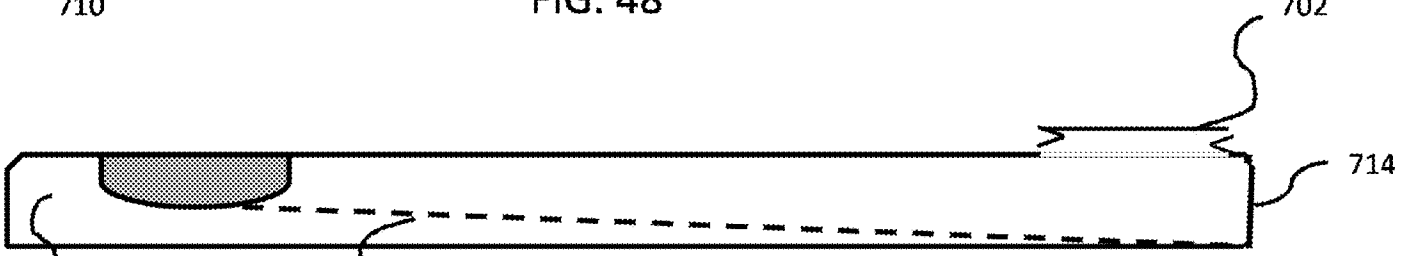
Figure 50:
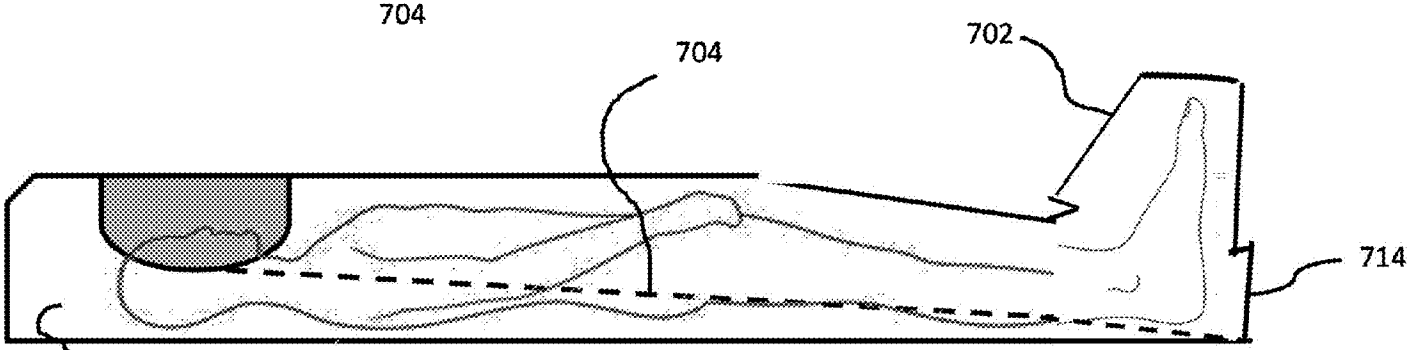

FIGS. 48-50 are side views of the exemplary configuration of the ergonomic canopy 702 incorporated in a puffier, more structured, and more tapered mummy bag. The draw-cord hood is highlighted by 710. The ergonomic foot canopy is highlighted by 702. Element 714 highlights the end of the exemplary mummy bag which can have more structural height. In FIG. 48, the ergonomic canopy 702 is fastened down. In FIG. 49, the ergonomic canopy 702 is released. In FIG. 50, the ergonomic canopy 702 is extended and in use. Element 704 indicates the side zipper.

Figure 51:
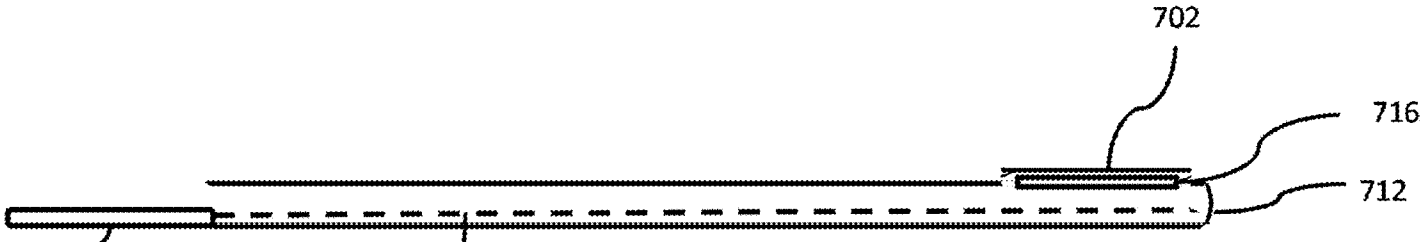
FIGS. 51-53 illustrate a side view of an exemplary configuration of the ergonomic canopy with heating elements in a rectangular sleeping bag with a head flap, as it unfastens and expands.
Figure 52:
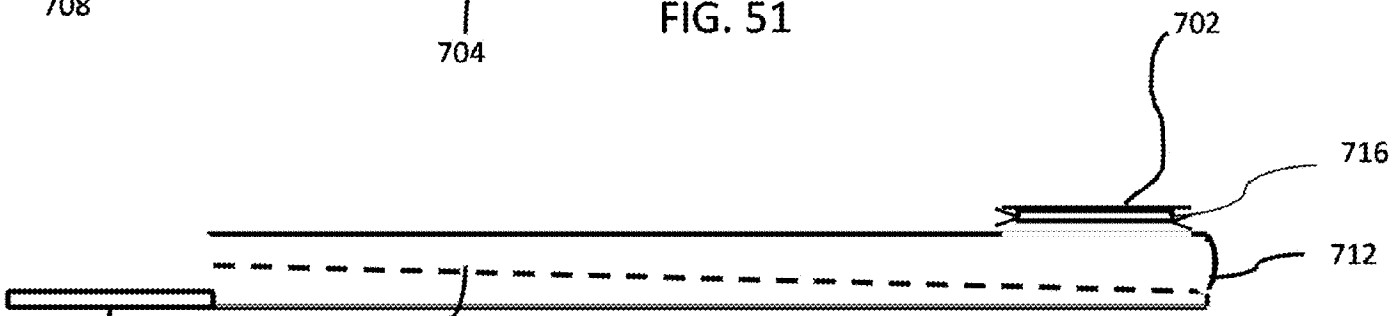
Figure 53:
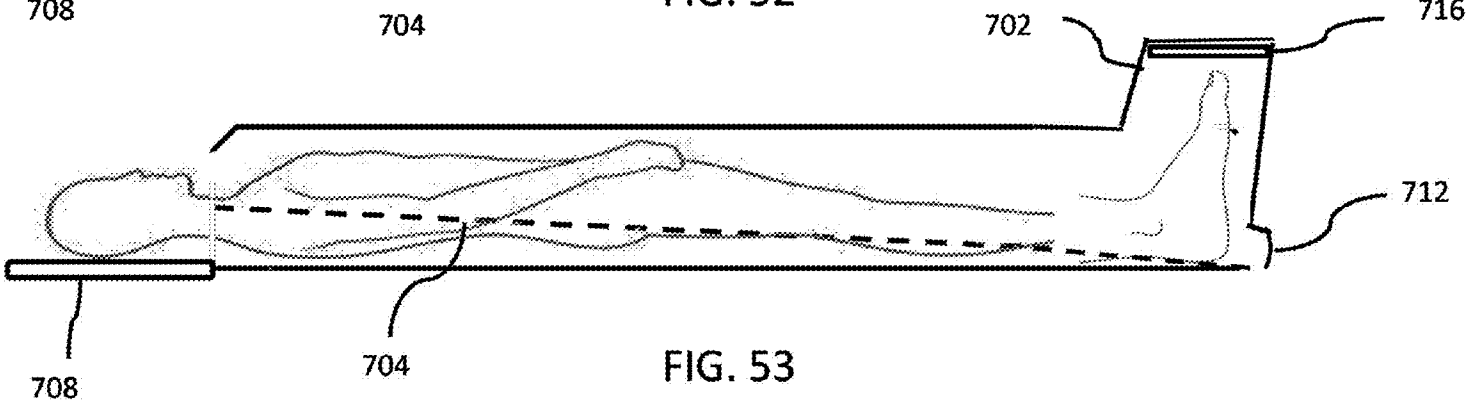

FIGS. 51-53 are side views of a similar exemplary configuration of a rectangular sleeping bag with a head flap 708 and with the ergonomic canopy 702, as shown in FIGS. 45-47. The inclusion of electrical heaters in the canopy ceiling, indicated by 716, are present in this embodiment. The number and type of heating elements can vary greatly with various exemplary configurations of heating elements, as shown in FIGS. 11, 13, and FIGS. 14-36 providing guidance. Other heating elements, suitable shapes, and configurations are contemplated based on the teachings of the present invention, as will be appreciated by those of ordinary skill in the relevant art(s). The side zipper which could also secure the bottom of the bag is highlighted by 704.

Figures 54, 55, 56:
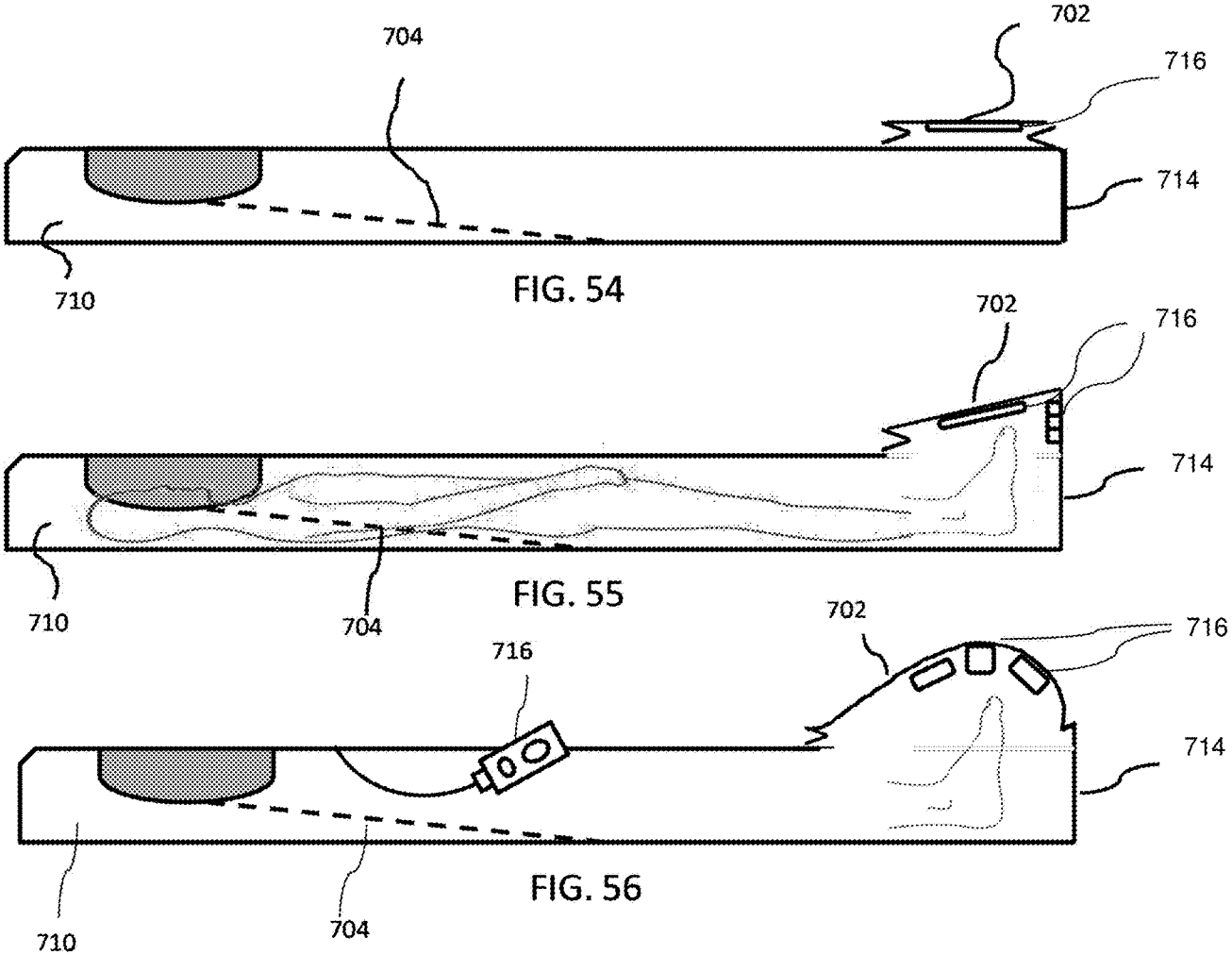
FIGS. 54-56 illustrate an exemplary configuration of the ergonomic canopy in a mummy bag as it expands as shown in FIGS. 48-50 with the inclusion of various exemplary configurations of heating elements as shown in FIGS. 11, 13 and FIGS. 14-36, wherein FIG. 56 introduces an exemplary configuration of controls for the heating elements.

FIGS. 54-56 are side views of a similar exemplary configuration of a mummy bag and with the ergonomic canopy 702, as shown in FIGS. 48-50. The inclusion of electrical heaters in the canopy ceiling, indicated by 716, are present in this embodiment. The number and type of heating elements can vary greatly with various exemplary configurations of heating elements, as shown in FIGS. 11, 13, and FIGS. 14-36 providing guidance. Other heating elements, suitable shapes, and configurations are contemplated based on the teachings of the present invention, as will be appreciated by those of ordinary skill in the relevant art(s). The side zipper which could also secure the bottom of the bag is highlighted by 704. A controller of the heating elements is shown in FIG. 56. The controller can be located anywhere for design or ergonomic reasons including inside the respective bags for easy access from within the bag, which is very advantageous on those cold evenings when the feet are cold but the user would prefer not to have to get out of the bag and/or expose a limb.

Accordingly, an ergonomic foot canopy for a sleeping bag can be configured in any suitable shape, based on the teachings of the present invention, wherein the sleeping bag can include a retractable foot canopy that can be electrically heated, and is configured to allow the feet of a user to be extended in an upward direction therein, providing room and maneuverability and warmth for the feet of the user, as will be appreciated by those of ordinary skill in the relevant art(s). While the present invention has been described in connection with a number of exemplary embodiments and implementations, the present invention is not so limited but rather covers various modifications and equivalent arrangements, which fall within the purview of the appended claims.

What is claimed is:

1. A sleeping bag, comprising:

a top portion;

a bottom portion; and the bottom portion including a back-folded foot canopy therein configured to allow expansion when feet of a user are extended in an upward direction therewithin and providing room and maneuverability for the feet of the user;

wherein the sides of the foot canopy comprise walls formed by back folds each extending substantially across a width of the bottom portion and said walls and back folds are opposite and spaced apart from each other.

2. The sleeping bag of claim 1, wherein the bottom portion includes the foot canopy being electrically heated and providing warmth from a heating element incorporated into at least one of a ceiling of the foot canopy, and sides of the foot canopy.

3. The sleeping bag of claim 1, wherein a top or ceiling of the back-folded foot canopy is one of a rectangular shape, a dome shape, a round shape, and a pointed shape.

4. The sleeping bag of claim 1, wherein sidewalls of the back-folded foot canopy allow for expansion due to a hairpin fold that functions as a large pleat when in use, and/or flexible material, and including a pleated or accordion-type structure that also allows the canopy to further drape the feet when in use.

5. The sleeping bag of claim 1, wherein the foot canopy is configured as a vaulted foot-tent at the bottom portion of the sleeping bag.

6. The sleeping bag of claim 1, wherein the back-folded foot canopy is made from the same or similar material to the top portion of the sleeping bag.

7. The sleeping bag of claim 1, wherein the back-folded foot canopy is made from a different material than the top portion of the sleeping bag.

8. The sleeping bag of claim 2, wherein the heating element comprises insulated wires including carbon fiber wires that heat up when a control is on and when plugged into a wall electrical socket or connected to a battery.

9. The sleeping bag of claim 1, wherein the bottom portion includes the foot canopy which is electrically heated and provides warmth from a single heating element or multiple heating elements incorporated into at least one of the ceiling or sides of the foot canopy.

* * * * *